US008127379B2

(12) United States Patent
Hardee

(10) Patent No.: US 8,127,379 B2
(45) Date of Patent: Mar. 6, 2012

(54) RECLOSABLE LOCKING TAPE

(76) Inventor: Patrice L. Hardee, Beaufort, SC (US)

( * ) Notice: Subject to any disclaimer, the term of this patent is extended or adjusted under 35 U.S.C. 154(b) by 378 days.

(21) Appl. No.: 12/456,571

(22) Filed: Jun. 18, 2009

(65) Prior Publication Data

US 2009/0313795 A1 Dec. 24, 2009

Related U.S. Application Data

(60) Provisional application No. 61/132,463, filed on Jun. 19, 2008.

(51) Int. Cl.
*A47G 9/04* (2006.01)
*A44B 1/04* (2006.01)

(52) U.S. Cl. ..... 5/493; 24/585.1; 24/585.11; 24/399; 24/400; 160/368.1

(58) Field of Classification Search ..... 5/493; 160/38, 160/368.1, 349.2; 24/399, 400, 585.1, 585.11, 24/72.5, DIG. 50
See application file for complete search history.

(56) References Cited

U.S. PATENT DOCUMENTS 3,462,332 A 8/1969 Goto
3,996,987 A 12/1976 Rodriguez
4,587,683 A 5/1986 Gardiner
4,691,373 A * 9/1987 Ausnit ..... 383/63
4,708,183 A 11/1987 Figueroa
4,864,654 A 9/1989 Schriver et al.
4,939,819 A 7/1990 Moyer
5,009,828 A 4/1991 McCree
5,060,712 A 10/1991 Ehrlich
5,070,584 A 12/1991 Dais et al.
5,140,727 A 8/1992 Dais et al.
5,205,003 A 4/1993 Green
5,240,758 A 8/1993 Honigberg
5,335,383 A 8/1994 Schwind
5,356,222 A 10/1994 Kettner et al.
5,367,729 A 11/1994 Lazar et al.
5,520,449 A 5/1996 Klak
5,540,480 A 7/1996 Christa
5,597,025 A 1/1997 Forkner
5,621,931 A 4/1997 Hamilton
5,647,100 A 7/1997 Porchia et al.
5,673,741 A 10/1997 Cairns
5,749,658 A * 5/1998 Kettner ..... 383/204
5,894,642 A 4/1999 Eberhardt
6,017,601 A 1/2000 Amsel
6,021,557 A 2/2000 Dais et al.
6,065,872 A * 5/2000 Johnson ..... 383/63
6,138,329 A * 10/2000 Johnson ..... 24/584.1
6,154,934 A * 12/2000 Matthews ..... 24/585.1
6,192,962 B1 2/2001 Glover
6,450,685 B1 9/2002 Scott (Continued)

*Primary Examiner* — Michael Trettel

(57) ABSTRACT

A reclosable locking tape for releasably attaching a fabric add-on to a foundation includes: (a) a substantially planar tape base to which is affixed at least one male locking portion that is generally mushroom-shaped and includes a stem affixed to a cap; and (b) at least one female locking portion affixed to the tape base, the female locking portion including two same-sized hook members on opposite sides of a male portion-sized space in the female portion. Also included are a reclosable rib and groove tape assembly that includes: (a) a fabric add-on including at least one longitudinally extending rib or groove on a substantially planar and flexible portion backing; and (b) a separate foundation attachment portion including at least one rib or groove on a substantially planar portion backing, the rib or groove of the foundation attachment portion corresponding to the rib or groove of the add-on attachment portion, and a related method.

17 Claims, 18 Drawing Sheets

U.S. PATENT DOCUMENTS 6,691,383 B2 * 2/2004 Linton ..... 24/585.12
6,721,999 B2 * 4/2004 Meager ..... 24/399
6,722,784 B2 4/2004 Breil, Jr.
6,986,928 B2 1/2006 Almansa Perea
7,089,611 B1 8/2006 Jones et al.
7,207,078 B1 4/2007 Lakic
7,281,281 B2 10/2007 Langenberger
7,337,480 B2 3/2008 Borino
7,340,807 B2 3/2008 Dais et al.
7,410,298 B2 8/2008 Pawloski
7,478,950 B2 1/2009 Plourde et al.
7,494,280 B2 2/2009 Gzybowski
7,506,487 B2 3/2009 Eads et al.
7,537,386 B2 5/2009 Linton et al.
7,540,662 B2 6/2009 Thieman
7,543,362 B2 6/2009 Olechowski
2004/0221389 A1 11/2004 McClelland et al.
2005/0086740 A1 4/2005 Babjak
2005/0139333 A1 6/2005 Granger
2007/0022534 A1 2/2007 Richards
2008/0019619 A9 1/2008 Eads et al.
2008/0044112 A1 2/2008 Anderson
2008/0159662 A1 7/2008 Dowd et al.
2008/0172846 A1 7/2008 Russell et al.
2008/0232722 A1 9/2008 Pawloski et al.
2008/0273819 A1 11/2008 Hannon et al.
2008/0285894 A1 11/2008 Stolmeier
2009/0142007 A1 6/2009 Bois
2009/0148080 A1 6/2009 Gzybowski

* cited by examiner

RECLOSABLE LOCKING TAPE

CROSS REFERENCE TO RELATED DOCUMENT

Benefit is claimed under 35 USC 119(e) of provisional U.S. patent application No. 61/132,463, filed on Jun. 19, 2008.

BACKGROUND OF THE INVENTION

1. Technical Field

The present invention relates generally to a reclosable locking tape closure for use on various fabric articles and corresponding foundations, a reclosable locking tape assembly including an add-on attachment portion and a separate foundation attachment portion, and a method using the reclosable locking tape to releasably attach a fabric add-on to a foundation, such as a bed skirt, pillow sham, tablecloth, shower curtain, or curtain add-on to a box spring, table top, shower rod, or cornice board foundation, respectively.

2. Background Information

Currently, in order to wash a bed skirt, the mattress lying on the top of the bed skirt must be lifted off, and the bed skirt removed from the box spring beneath it. The mattress is usually replaced on the box spring while the conventional bed skirt is washed and dried. The mattress is then removed again and the bed skirt is replaced. The mattress must then be replaced on the box spring without moving the bed skirt out of alignment. This is especially difficult to do when the mattress is queen or king sized, particularly for a single person of diminutive stature.

In a preferred embodiment of the present invention, a removable bed skirt can be removed, washed, dried, and replaced without ever moving the mattress above it. An add-on attachment portion of the releasable rib and groove tape assembly is simply peeled away from a foundation portion of the rib and groove tape assembly in order to remove the bed skirt or other fabric add-on for washing or replacement. In an alternative embodiment of the invention, an edge of the mattress is lifted slightly to reattach the bed skirt fabric add-on portion of the rib and groove tape assembly to the foundation portion of the rib and groove tape assembly on the box spring foundation. The mattress need not be removed in order to remove the bed skirt.

Some conventional bed skirts have a deck section, or center panel, which holds the bed skirt in position while the mattress is being placed on the top. Here, the easily removable bed skirt fabric add-on does not require a deck section, since the rib and groove assembly holds the bed skirt in place.

The present invention is also useful for removably attaching a curtain to a cornice board, curtain rod, or the like, a pillow sham to a decorator pillow, a shower curtain to a shower rod or the like, a draped tablecloth to a table top, etc. Hook and loop strips need not be employed herein, and the bed skirt or other fabric add-on remains taut over time while the rib and groove assembly is in use.

BRIEF SUMMARY OF THE INVENTION

The present invention is a rib and groove attachment tape assembly for reclosably attaching a fabric add-on to a foundation that includes: (a) an add-on attachment portion comprising at least one longitudinally extending rib or at least one longitudinally extending groove on a substantially planar, substantially flexible portion backing; and (b) a separate foundation attachment portion comprising the rib or groove on a substantially planar, substantially flexible portion backing. The tape assembly comprises one of the ribs on one of the attachment portions for every one of the grooves on a corresponding one of the attachment portions. The rib in transverse cross-section comprises a knob-shaped member on a stem. The rib stem extends substantially perpendicularly from the corresponding portion backing. The groove includes a groove well, the rib knob-shaped member extending into the groove well when the rib is in the corresponding groove of the corresponding attachment portion.

Also included herein is a method for hanging a fabric add-on on a foundation using a reclosable rib and groove tape assembly, comprising the steps of: (a) attaching a lower surface of an add-on attachment portion of the reclosable rib and groove tape assembly adjacent a longitudinal edge of a fabric add-on; (b) attaching a lower surface of an opposite, foundation attachment portion of the reclosable rib and groove assembly onto a surface of a foundation; (c) reclosably attaching the fabric add-on to the foundation by aligning the add-on attachment portion along the foundation attachment portion and pressing at least one rib of the add-on attachment portion into at least one, corresponding groove of the foundation attachment portion, or vice versa; and (d) removing the fabric add-on from the foundation by pulling the at least one rib of one attachment portion out of the at least one groove of the opposite attachment portion.

Also included herein is a reclosable locking tape for releasably attaching an add-on to a foundation, which includes: (a) a substantially planar tape base to which is affixed at least one male locking portion, the male locking portion being generally mushroom-shaped in transverse cross section and comprising a stem affixed to a cap at one end of the stem, an opposite end of the stem being affixed to the tape base; and (b) at least one female portion affixed to the tape base. The female portion corresponds to the male portion and includes two same-sized hook members that face toward one another on opposite sides of a male portion-sized space at the center of the female portion. The male portion of a first strip of the reclosable locking tape releasably couples with the corresponding female portion of a second, corresponding strip of the reclosable locking tape.

The present invention also includes a reclosable locking tape assembly including complementary segments of the reclosable locking tape that are attached to an add-on made of fabric, plastic, or the like, and a corresponding foundation.

The releasable locking tape/assembly and related method of the present invention have a number of advantages, particularly in the areas of sewing, crafts, and interior decorating, including the following:

1) The tape assembly of the invention saves time, especially in removing the bed skirt or other fabric add-on for cleaning. The assembly also saves labor in the bed skirt application in that the bed mattress need not be removed twice. In the cornice board application, the cornice board need not be removed, the curtain discarded, and a new curtain stapled onto the cornice board.

2) The removable bed skirt, curtain, pillow case, shower curtain or other fabric add-on is easily replaced, permitting quicker and more frequent design changes in the room.

3) The bed skirt need not have a deck section; the rib and groove tape assembly holds the bed skirt in precise alignment on the box spring.

4) The bed skirt, curtain, pillow sham, or other fabric add-on can be reversible, which permits quick design changes without having to search through the house for a stored second bed skirt, etc.

5) When the present tape assembly is in use, the fabric of the bed skirt or other fabric add-on is held taut without puckering.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
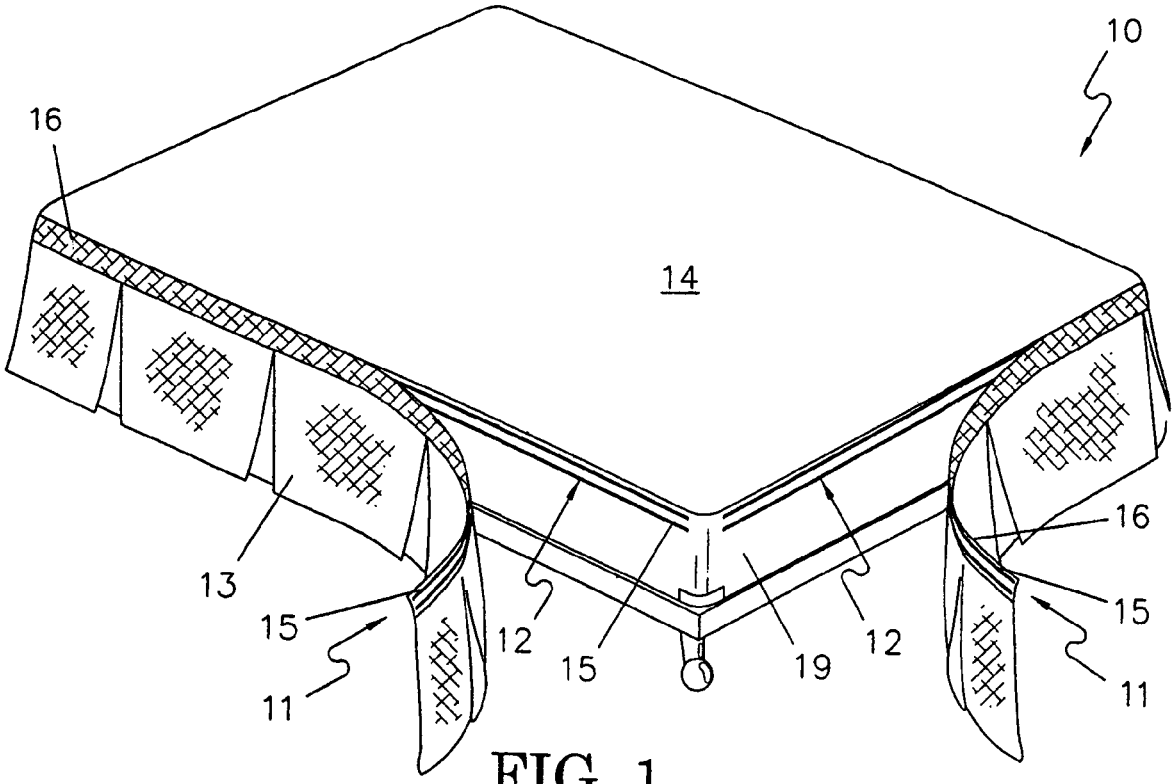
FIG. 1 is a perspective view of a reclosable rib and groove zip lock tape according to the present invention, shown in use attaching a bed skirt to a side of a box spring.

In the following description, like reference characters designate like or corresponding parts throughout the several views. Also, in the following description, it is to be understood that such terms as "top," "bottom," and the like are words of convenience and are not to be construed as limiting terms. Referring in more detail to the drawings, the invention will now be described.

Figure 2:
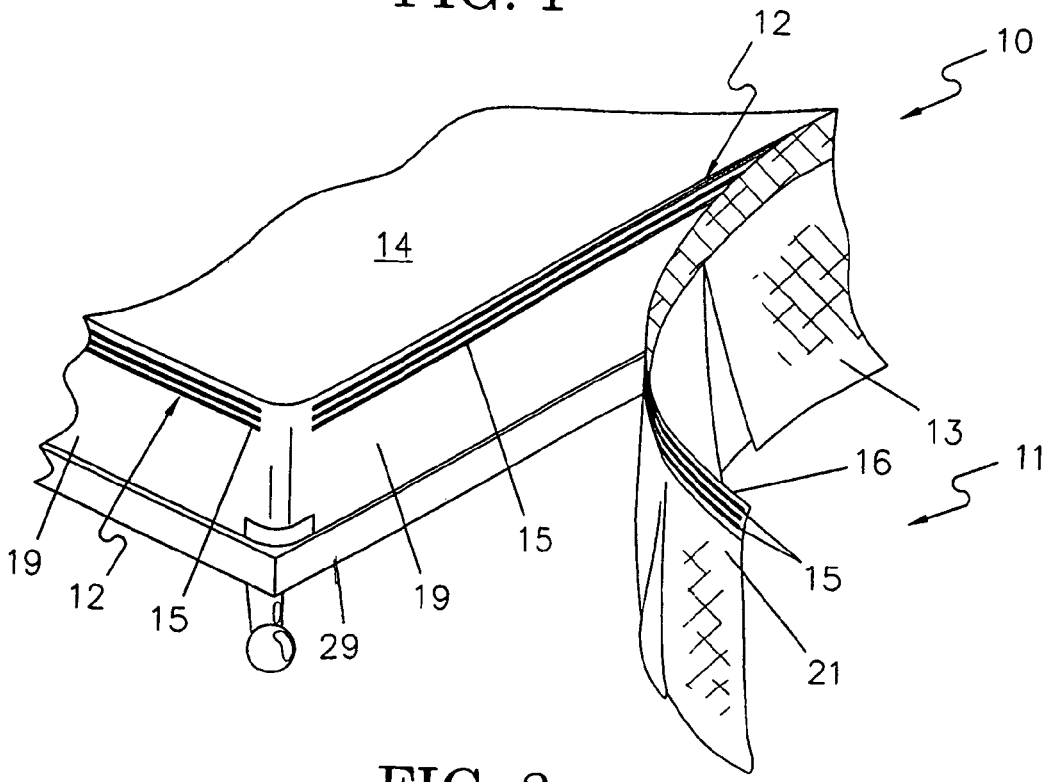
FIG. 2 is a perspective view of a reclosable rib and groove tape according to the present invention, shown attaching a bed skirt to a side of a box spring.

Referring to FIGS. 1 and 2, a reclosable rib and groove tape assembly 10 includes two rib and groove portions: an add-on attachment portion 11 and a corresponding foundation attachment portion 12. A lower surface 26 of the add-on attachment portion 11 is attached to an inside (rear) surface 21 of the fabric add-on 13, such as the bed skirt shown in FIGS. 1 and 2. Similarly, a lower surface 26 of the foundation attachment portion 12 attaches to an upper surface of the foundation 14 or other substrate, such as the upper surface of the sides 19 or top 20 of a box spring shown in FIGS. 1 and 2. The rib and groove portions 11, 12 releasably attach to one another.

The releasable fabric rib and groove tape assembly 10 includes at least two substantially parallel rib or groove tracks 15 on the fabric add-on 13 and the same number of corresponding rib or groove tracks 15 on the foundation 14, as seen in FIGS. 1-5. By "tracks" is meant a set of ribs/male portions, or grooves/female portions as described herein. Preferably, the set of ribs 17 is part of one rib/groove portion 11, 12, and the set of corresponding grooves 18 is part of the opposite rib/groove portion 11 or 12. Since the ribs 17 fit into the grooves 18 in sealing engagement, the tracks 15 on each rib/groove portion 11, 12 are spaced apart by substantially the same distance as one another (no transverse links as in railroad tracks, though). Once they are releasably interlocked, the ribs 17 and grooves 18 cooperate to hold the bed skirt, curtain, or other fabric-add-on 13 tautly in place on the box spring, cornice board, or other foundation 14 without puckering.

The rib and groove attachment tape assembly 10 preferably includes two substantially parallel rib or groove tracks 15 on the fabric add-on 13 and two corresponding rib or groove tracks 15 on the foundation 14, as seen in FIG. 1, or three substantially parallel rib and groove tracks 15 on the fabric add-on 13 and three corresponding rib or groove tracks on the foundation 14, as shown in FIG. 2. The number of rib/groove tracks 15 employed depends largely on the weight of the fabric add-on 13. In general, a heavier or greater amount of fabric in the fabric add-on 13 requires a greater number of rib and groove tracks 15 to hold it up. The fabric add-on 13 may include plastic or other materials in addition to some type of fabric.

The number of rib/groove tracks 15 employed also generally depends on the position of the tracks 15 and sturdiness of the foundation 14. For example, a fabric add-on 13, such as a valance, that will be suspended above the ground on a substantially vertical foundation surface generally requires a greater number (e.g., about three) of substantially horizontally positioned tracks 15 to hold the fabric add-on 13 in place despite the downward pull of gravity. The rib and groove tape assembly 10 includes between two and about ten tracks 15, most preferably two sets of two or three tracks. The foundation attachment portion 12 includes the same number of rib/groove tracks 15 as the add-on attachment portion 11, since the rib and groove tracks 15 correspond to one another.

Figure 5:
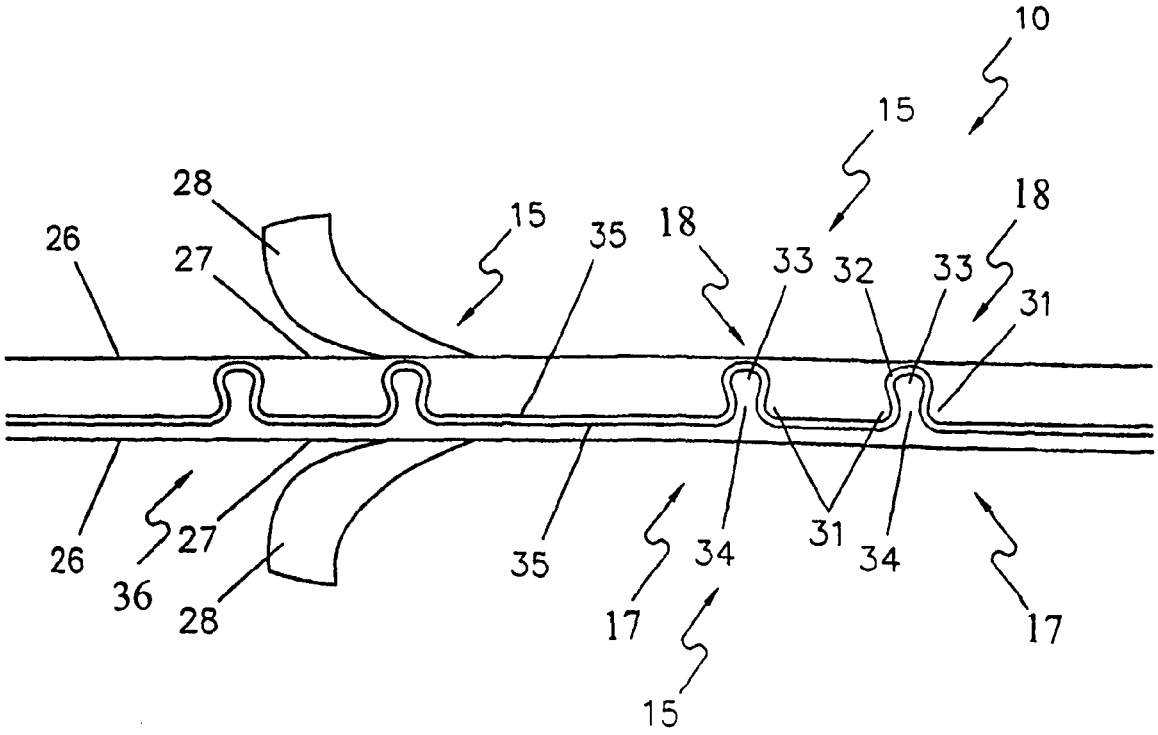
FIG. 5 is a cross-sectional view of a reclosable rib and groove tape according to the present invention.

As seen in FIG. 5, the add-on attachment portion 11 comprises a set of rib/groove tracks 15 on a portion backing 36. The foundation attachment portion 12 also comprises the set of rib/groove tracks 15, which correspond to the tracks on the opposite, add-on attachment portion 11, on a portion backing 36. Each set of tracks 15 comprises a set of ribs 17 or grooves 18. The ribs 17 and grooves 18 are attached to or formed from the portion backing 36. Preferably, two same-sized portion backings 36 are each made from a generally rectangular-shaped strip of durable, substantially flexible material, preferably cloth or thermoplastic material and most preferably a cloth binding tape. The rib/groove tracks 15 extend along a longitudinal axis of the generally rectangular-shaped backing on an upper surface 35 of the portion backing 36. The lower surface 26 of the add-on portion backing 36, which is preferably smooth, is attached to a top portion of an inside surface 21 of the bed skirt or other fabric add-on 13, preferably longitudinally. The lower surface 26 of the foundation portion backing 36 is attached to the foundation 14, normally along the edges or periphery of the sides 19 or top 20 of the foundation 14. Where the foundation 14 is a box spring as seen in FIGS. 1 and 2, three of the foundation attachment portions 12 are attached to the three exposed sides 19 of the box spring, with one foundation attachment portion 12 on each box spring side 19.

The attachment portions 11, 12 and the ribs 17 and grooves 18 are more preferably made from a thermoplastic material, such as polypropylene or linear low density polyethylene, that is sturdy enough to withstand repeated use and the heat of a washer and dryer. The ribs 17 and/or grooves 18 may be made separately and attached to a separately made strip of backing 36 using adhesive, staples, or any other suitable means, or the ribs 17 and grooves 18 are formed of the same material as the substantially planar portion backing 36 by molding, extruding, or any suitable means. Attachment portions 11, 12 with cloth backings are attached using a permanent adhesive. The rib and groove tape assembly 10 may or may not include cloth backings. The entire rib and groove tape assembly 10, including the backings, is attached to a foundation 14 by adhesive strips, staples, or by sewing the attachment portions onto the foundation. The portion backing 36 may be substantially the same width as the ribs 17 and grooves 18, or the portion backing 36 may extend an inch or so beyond the outer ribs or grooves on each side of the attachment portion.

Figure 4:
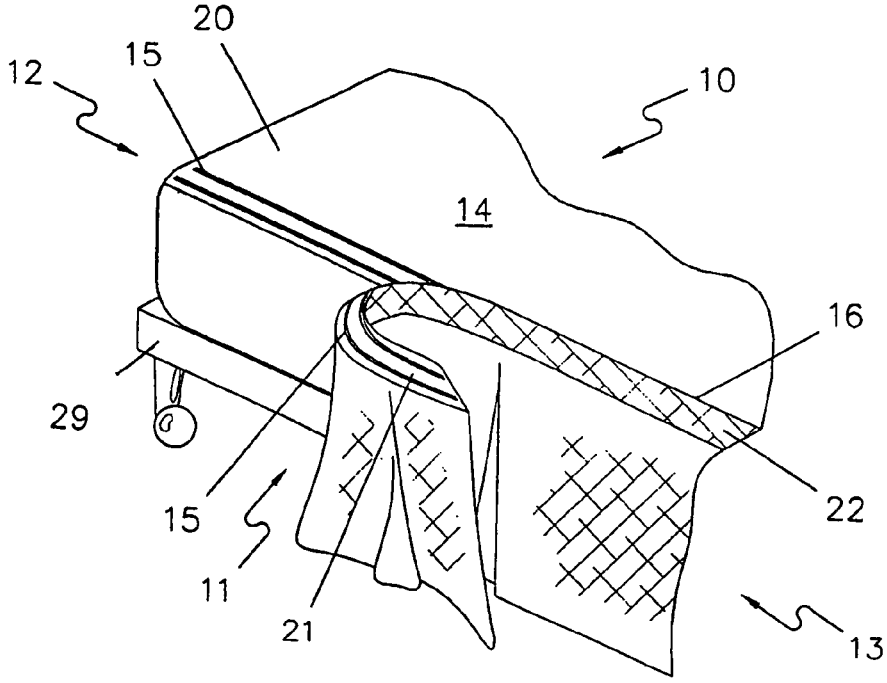
FIG. 4 is a perspective view of a corner portion of the reclosable rib and groove tape according to FIG. 3.

The length of the portion backing 36 is preferably about the same as the lengths of the attachment portion 11, 12 and the ribs/groove tracks 15. The fabric-add-on portion 11 preferably extends substantially the length of the fabric add-on 13, as seen in FIGS. 2 and 4. The add-on attachment portion 11 may extend the length of the fabric add-on, less about an inch at each end of the fabric add-on, if desired. The foundation attachment portion 12 preferably extends the length of the foundation side 19 or top 20, less about an inch at each end of the foundation side 19 or top surface 20, as seen in FIGS. 2 and 4. The add-on attachment portion 11 is preferably positioned about an inch below the upper longitudinal edge 16 of the inside surface 21 of the fabric add-on 13.

Figure 13:
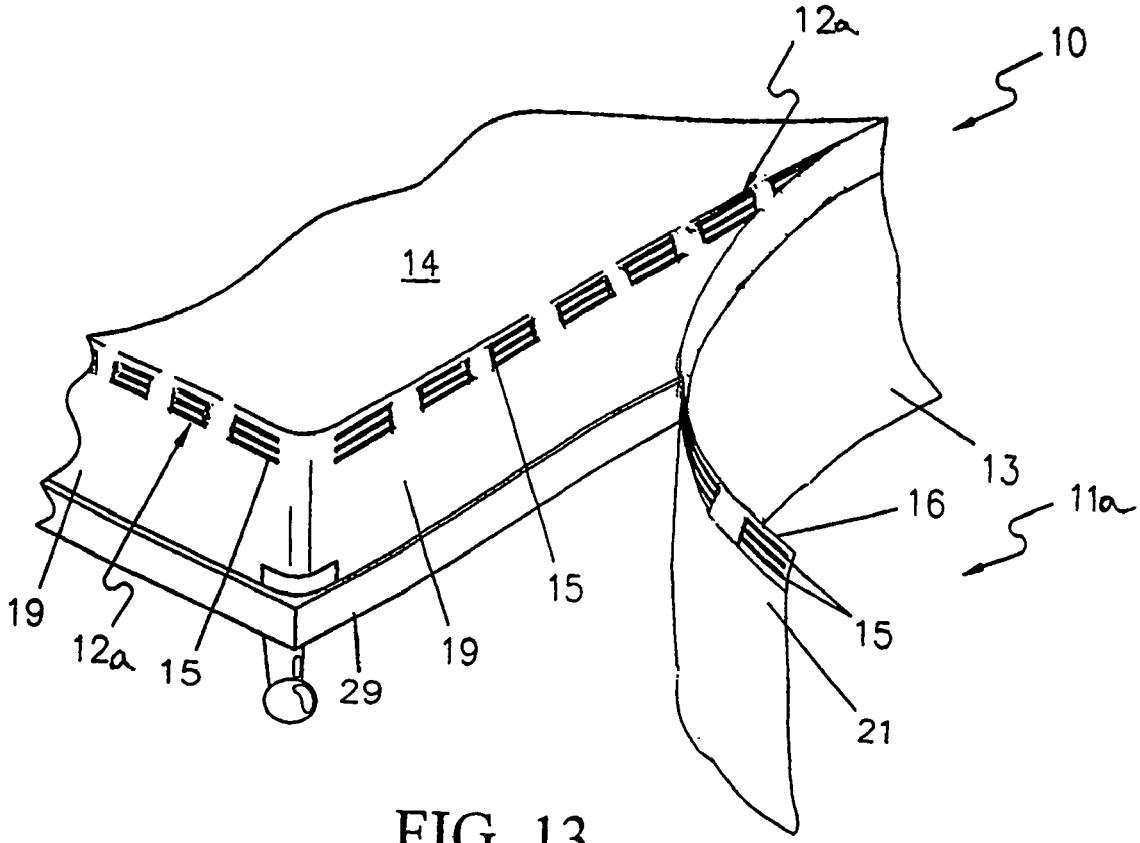
FIG. 13 is a perspective view of a reclosable rib and groove tape according to the present invention, shown on a bed.

The attachment portions 11, 12 need not extend continuously the entire length of the fabric-add-on 13 or foundation side 19 or top surface 20. The add-on attachment portion 11 and foundation attachment portion 12 are also available in segments, as seen in FIG. 13. The attachment portion segments 11*a*, 12*a* are preferably of about equal length and are spaced apart substantially equal distances in a line on the foundation 14 and the fabric add-on 13 (see FIG. 13). The attachment portion segments 11*a*, 12*a* are appropriate for uses where the fabric add-on 13 does not gap or hang down in the spaces between the attachment portion segments 11*a*, 12*a* once the fabric add-on 13 is applied to the foundation 14. Alternatively, the add-on attachment portion 11 can be segmented, and the foundation attachment portion 12 can extend continuously, or vice versa.

Each attachment portion 11, 12 comprises at least one rib 17 or at least one groove 18. The attachment portion 11, 12 may include one or two ribs 17, for example, and one or two grooves 18. The rib and groove assembly 10 of FIG. 5 has one attachment portion 11, 12 with two sets of grooves 18 and a corresponding attachment portion with two sets of ribs 17. Either attachment portion 11, 12 can be attached to the fabric add-on, with the opposite, corresponding portion being attached to the foundation. Ribs 17 and grooves 18 may alternate on the same attachment portion 11, 12. The ribs 17 and grooves 18 are preferably substantially parallel to one another, and to the upper longitudinal edge 16 of the bed skirt or other fabric add-on, as seen in FIGS. 1 and 2. The rib and groove assembly 10 may include two, four, or more sets of tracks 15 per attachment portion 11, 12, preferably but not necessarily in sets of two.

Figure 8:
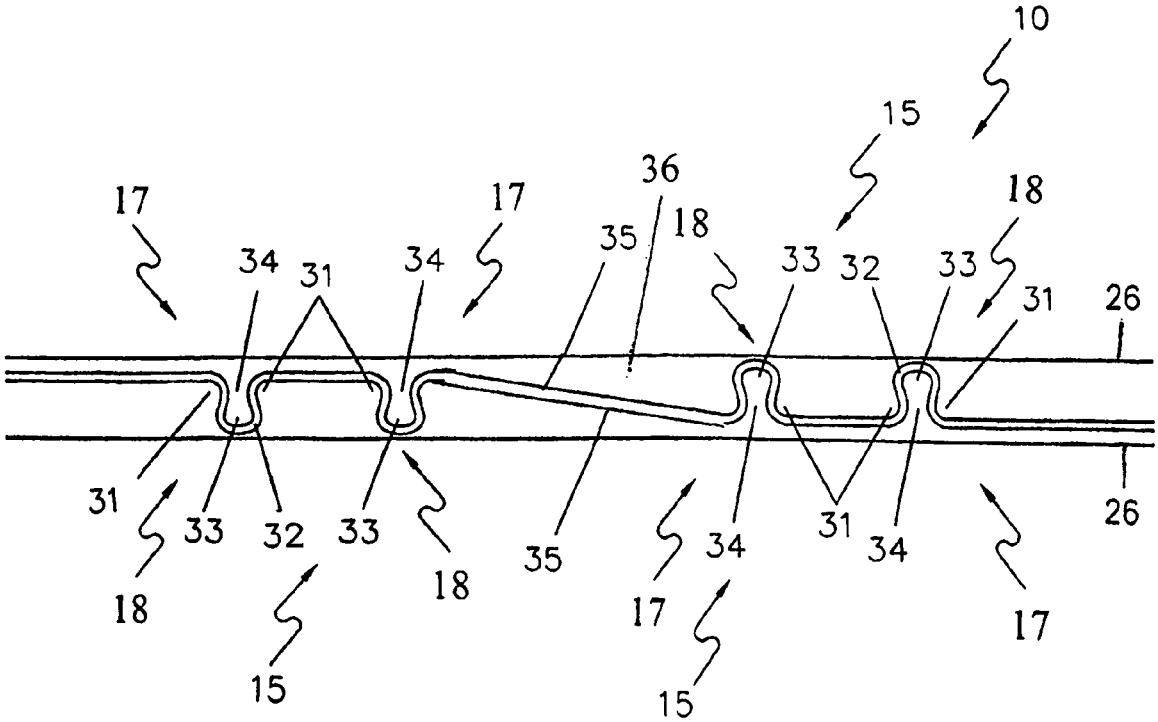
FIG. 8 is a cross-sectional view of a reclosable rib and groove fabric/plastic zip lock tape according to the present invention.

The rib and groove tape assembly 10 may include two sets of tracks 15 as seen in FIGS. 5 and 8. The two sets may be duplicate tracks 15, as seen in FIG. 5, or one set may be ribs and the adjacent set of tracks may be two parallel grooves, as seen in FIG. 8. In the rib and groove tape assembly 10 of FIG. 5, each groove 18 of the first attachment portion receives a corresponding rib 17 of the opposite, second attachment portion 11, 12. The first and second attachment portions are the add-on attachment portion 11 and the foundation attachment portion 12, in either order. In the rib and groove tape assembly 10 of FIG. 8, a first attachment portion 11, 12 has a set of ribs 17 that correspond to a set of grooves 18 on a corresponding, second attachment portion, as well as an adjacent set of grooves 18 that corresponds to a set of ribs 17 on the second attachment portion. The set of ribs 17 on the second attachment portion is also adjacent the set of grooves 18 on the second attachment portion.

Figure 3:
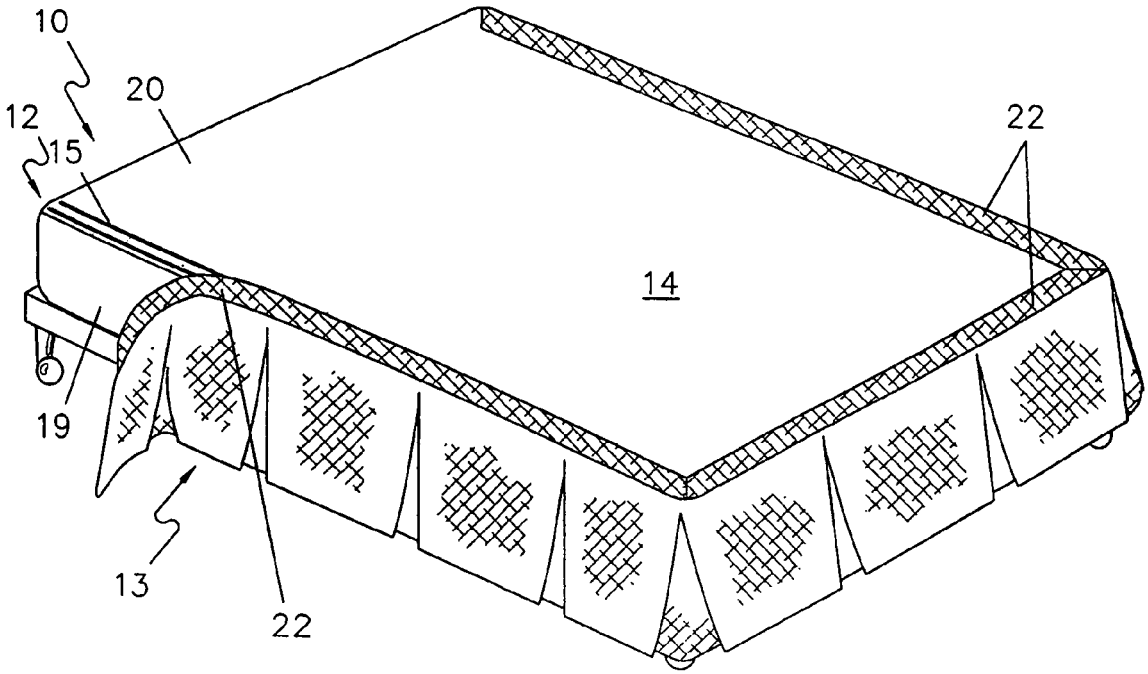
FIG. 3 is a perspective view of a reclosable rib and groove tape according to the present invention, shown attaching a bed skirt to a top edge of a box spring.

The lower surface 26 of the foundation attachment portion 12 is attached along the top edge of the three exposed sides of the box spring, as seen in FIGS. 1 and 2, or along the periphery of the top surface 20 of the box spring foundation 14 along the three exposed sides of the bed, as seen in FIGS. 3 and 4. No rib and groove assembly is needed along the top of the bed where it normally contacts a wall of the bedroom, since no bed skirt or other fabric add-on will be attached to that fourth side of the bed. If all four sides of the bed, table, etc. are exposed to viewing, the rib and groove tape assembly 10 is attachable along all four sides 19 or top 20. The box spring foundation 14 normally rests on a bed frame 29, which may or may not have wheels at each corner.

To reclosably attach the bed skirt on the bed, the rib or ribs 17 of the fabric add-on 13 are snapped into the corresponding groove or grooves 18 on a first, long side of the box spring foundation 14 by aligning the rib or ribs 17 and groove or grooves 18 and running the finger(s) of one hand along the outside of the upper panel 22 of the fabric add-on 13 starting from one end of the bed skirt. At the end of the first side 19 of the box spring, the user pulls the bed skirt fabric around the corner of the box spring and continues snapping the continuous rib 17 or ribs into the groove 18 or grooves on the second, shorter side of the box spring foundation in the same manner. At the end of the second, shorter side of the box spring, the user pulls the bed skirt fabric around the corner of the box spring and continues snapping the continuous rib 17 or ribs into the groove 18 or grooves on the third, long side 19 of the box spring foundation 14 in the same manner. The user continues until he or she reaches the ends of the rib(s) 17 and corresponding groove(s) 18.

The rib and groove portion backings 36 hold the area of fabric to which they are attached taut. The strips of portion backing 36 do not pucker. In use, the attachment portions 11, 12 are hidden by the fabric, mattress, height of the cornice board, etc. and are therefore not visible to the casual observer. The portion backings 36 are attached to an existing bed skirt or other fabric article (fabric add-on) by sewing or other suitable attachment means, and to an existing box spring or other foundation 14 using a suitable adhesive 27 with a peel-off cover strip 28. Preferably, the disposable peel-off cover strip 28 is made of paper, and the attachment portions are permanently attached to the fabric add-on and foundation. The attachment portions 11, 12 can be available in coiled lengths from which the consumer can cut the desired lengths as appropriate for the particular foundation. The coiled attachment portion length includes one or more sets of tracks 15 on its upper surface and peel-off cover strip 28 on its lower surface 26.

Figure 9:
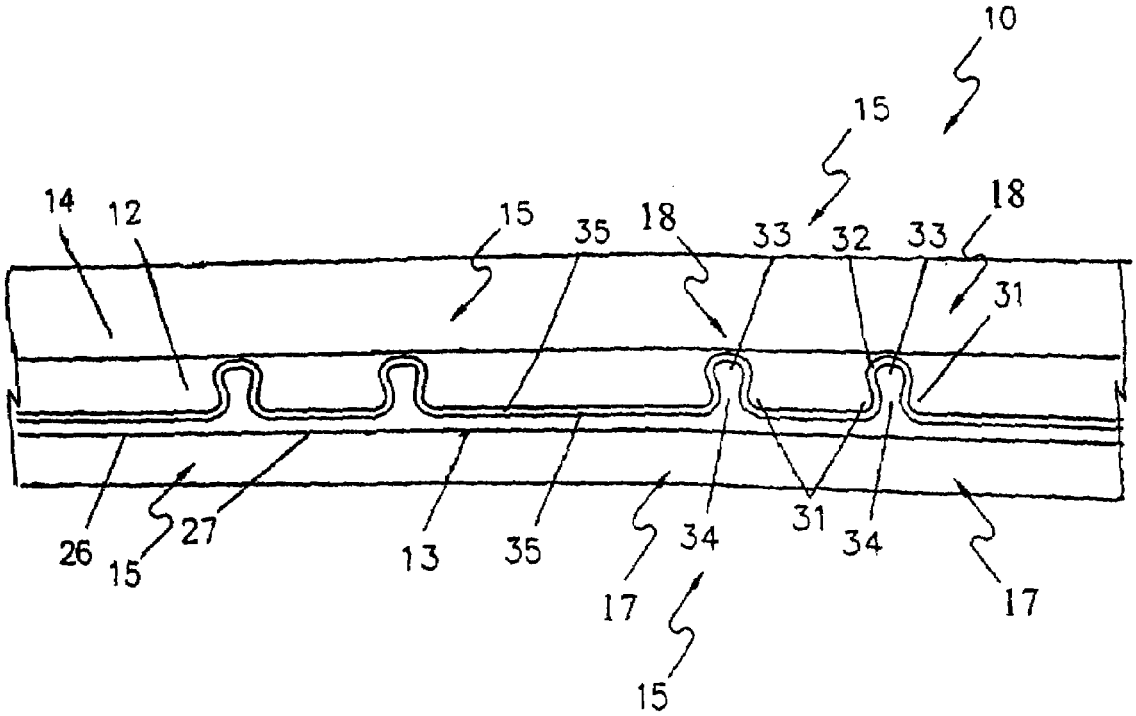
FIG. 9 is a cross-sectional view of a reclosable rib and groove tape according to the present invention, shown in use; a FIG. 10 is a cross-sectional view of a reversible, reclosable rib and groove tape according to the present invention.
Figure 10:
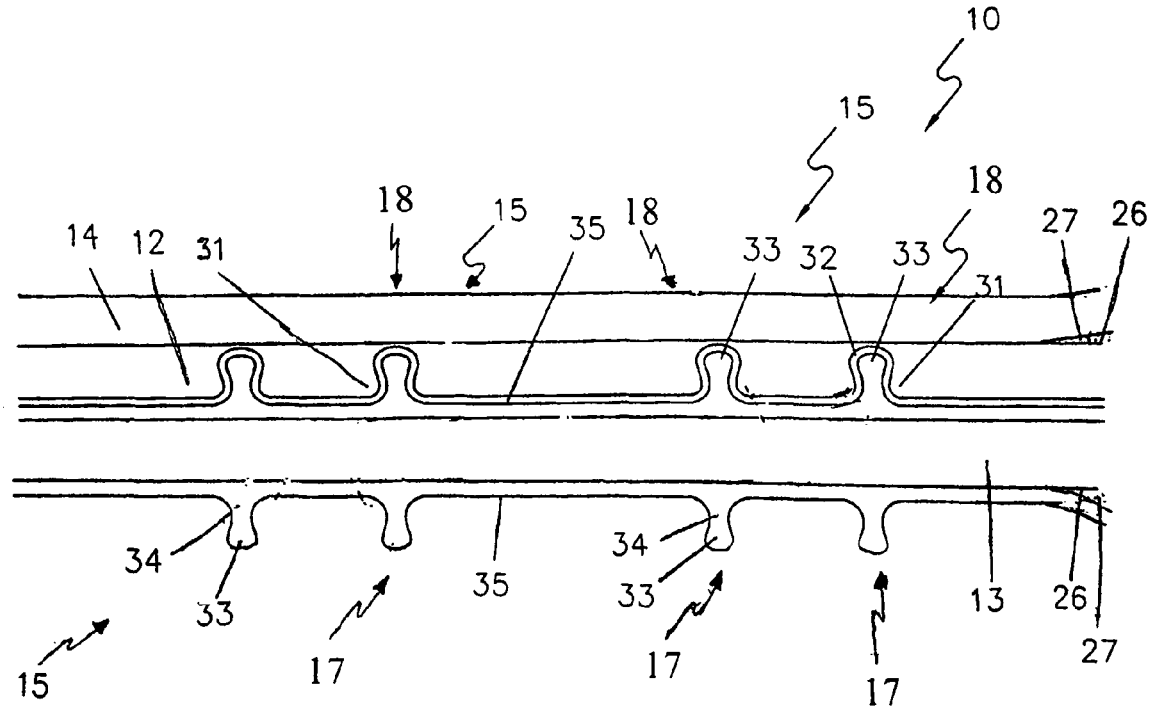

Referring to FIG. 9, the lower surface 26 of the add-on portion backing 36 with its adhesive 27 is pressed against the inside surface 21 of a top portion of the bed skirt or other suitable surface once the peel-off cover strip 28 shown in FIG. 5 is removed. As seen in FIGS. 9 and 10, the lower surface 26 of the foundation attachment portion backing 36 with its adhesive 27 is pressed against a surface of the foundation 14. The ribs 17 may extend up as seen in FIG. 9, or down, or some ribs may extend upwardly and some downwardly. The lower surfaces 26 of the portion backings 36 of the rib and groove tape assembly 10 in FIG. 10 are shown lifted slightly at one end in order to illustrate the lower backing surfaces 26 and adhesive 27.

Figure 14:
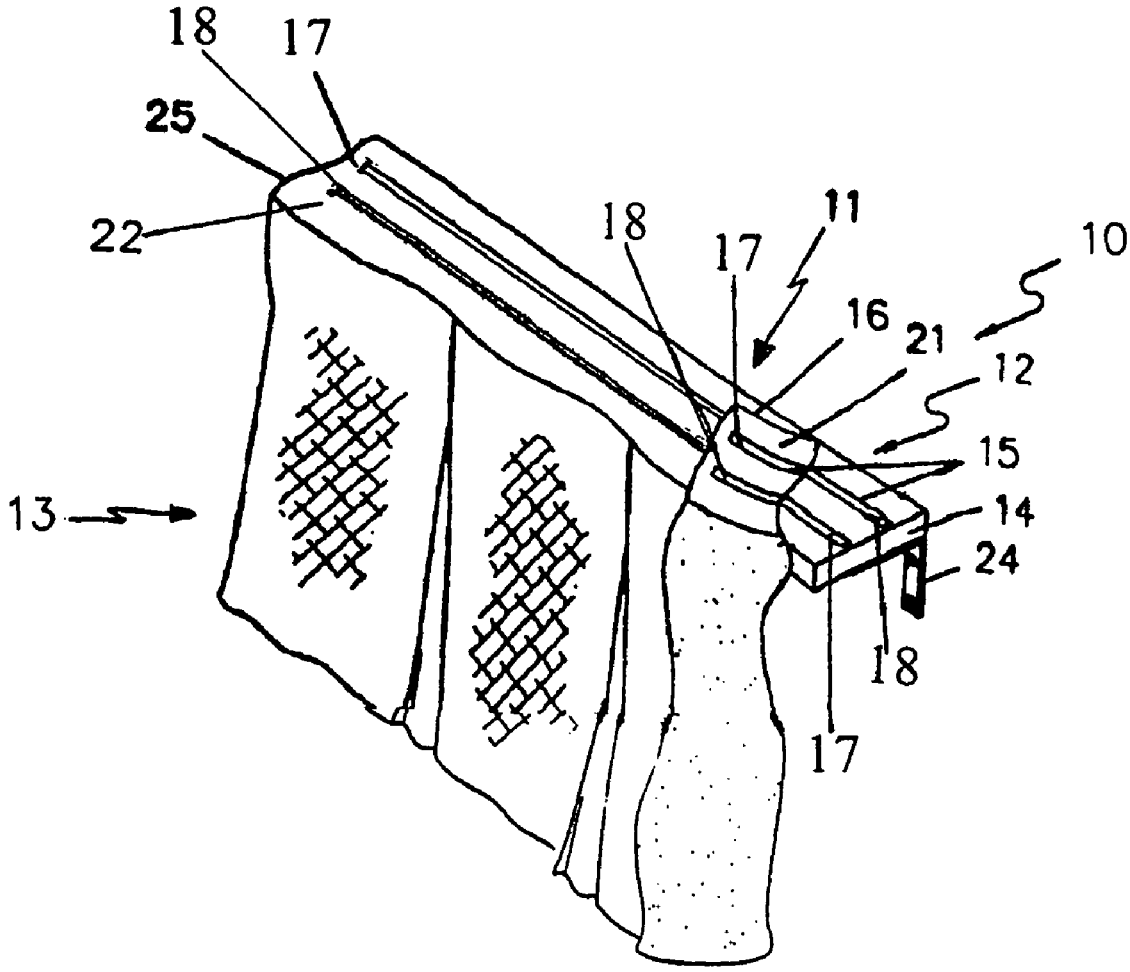
FIG. 14 is a perspective view of a reversible, reclosable rib and groove tape according to the present invention, shown on a cornice board.

Referring to FIGS. 10 and 14, the reclosable bed skirt, valance, or other fabric add-on 13 can be reversed to display a different design and/or color on the opposite side of the bed skirt, valance, etc., as desired. An add-on attachment portion 11 is attached adjacent the upper longitudinal edge 16 of the reversible bed skirt, curtain, or other fabric add-on 13. Tracks 15 on both sides of the fabric add-on 13 correspond to tracks 15 on the foundation attachment portion 12, which is attached to a cornice board foundation 14 in the rib and groove tape assembly 10 shown in FIG. 14. Alternatively, the foundation attachment portion 12 can be attached to a box spring as seen in FIGS. 3 and 4, or another suitable foundation.

While the ribs 17 of the add-on attachment portion 11 on one side of the fabric add-on 13 are in the grooves 18 of the foundation attachment portion 12 as shown in FIG. 10, or vice versa, the unused ribs 17 on the other side of the fabric add-on extend outwardly as seen in FIG. 10. Alternatively, the ribs 17 of the foundation attachment portion 12 on the foundation 14 are in the grooves 18 of the add-on attachment portion 11 on the fabric add-on 13. The ribs 17 not currently in use, though, are along the top edges of the box spring as seen in FIG. 2, and therefore hidden by the mattress. In the cornice board application, the unused ribs 17 are on top of an elevated cornice board as seen in FIG. 14, which is elevated. The unused ribs, which are on the upper panel 22 on the side of the fabric add-on 13 that is being displayed, are therefore not readily visible to guests or other passersby.

In the rib and groove tape assembly 10 of FIG. 14, the tracks 15 each include a rib 17 and a groove 18, with the ribs 17 on the valance fabric add-on 13 corresponding to the groove 18 on the cornice board foundation 14, and the grooves 18 on the valance fabric add-on 13 corresponding to the rib 17 on the cornice board foundation 14. The rib 17 and groove 18 on one side of the valance are attached to the rib 17 and groove 18 on the cornice board foundation 14, depending on which side of the valance the user has chosen to display. The valance can be flipped to change the room décor for holidays or changing seasons, for example.

As seen in the transverse cross-sections of FIGS. 5 and 8-10, each rib 17 comprises a knob-shaped member 33 on the end of a stem 34. The knob-shaped member 33 and the rib stem 34 extend out from the upper surface 35 of the portion backing 36 generally perpendicular to the substantially flexible portion backing 36. The knob-shaped member 33 extends into the groove well 32 when the rib 17 is in the groove 18 of the corresponding attachment portion 11, 12. The curved sides 31 of the substantially flexible groove material preferably clasp the knob-shaped member 33 and stem 34 closely. The rib 17 does not slide out of the groove 18, even where the bed skirt, curtain, or other fabric add-on is hanging substantially vertically.

If the user wishes to remove/replace the fabric add-on, the interlocked attachment portions 11, 12 can easily be pulled apart and snapped back together with little effort. Preferably, the user feels a bump in the fingers as the elongated rib 17 snaps into the opposite, elongated groove 18. A snap sound is preferably audible to the user as the rib 17 pops into the corresponding groove 18.

Figure 6:
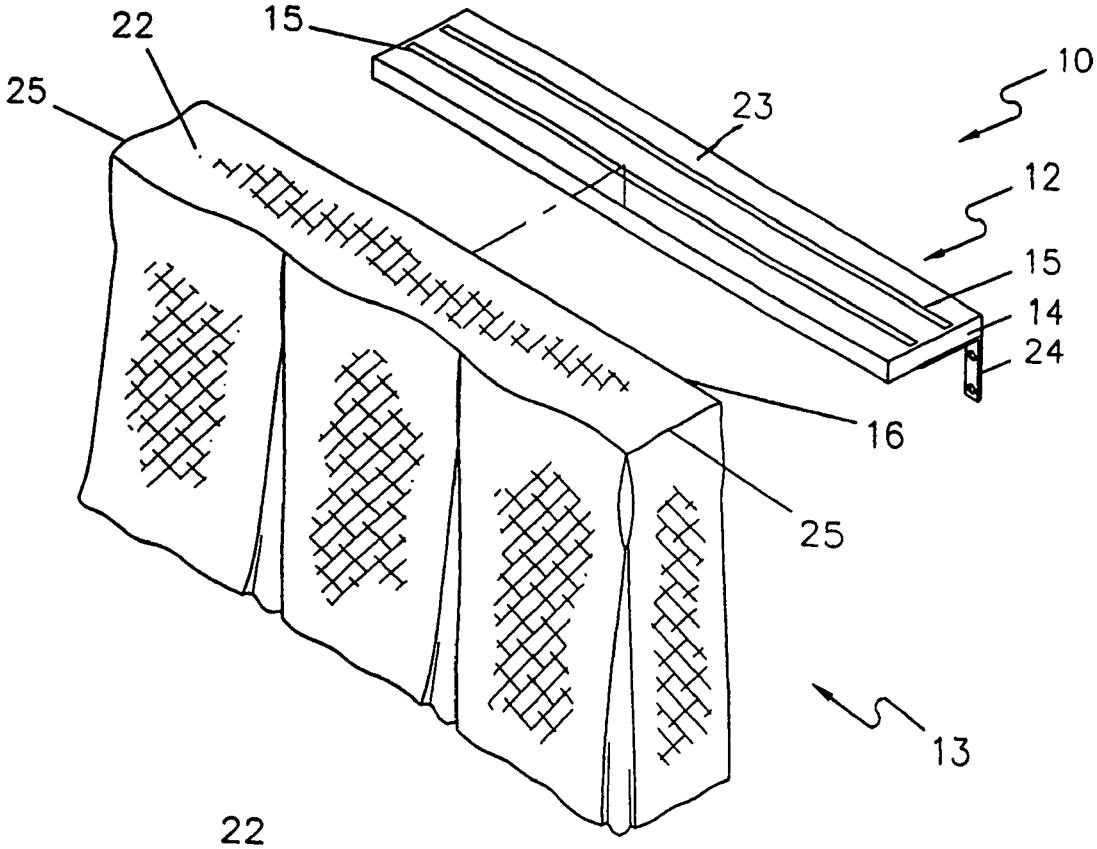
FIG. 6 is a perspective view of a reclosable rib and groove tape according to the present invention, shown on a cornice board.
Figure 7:
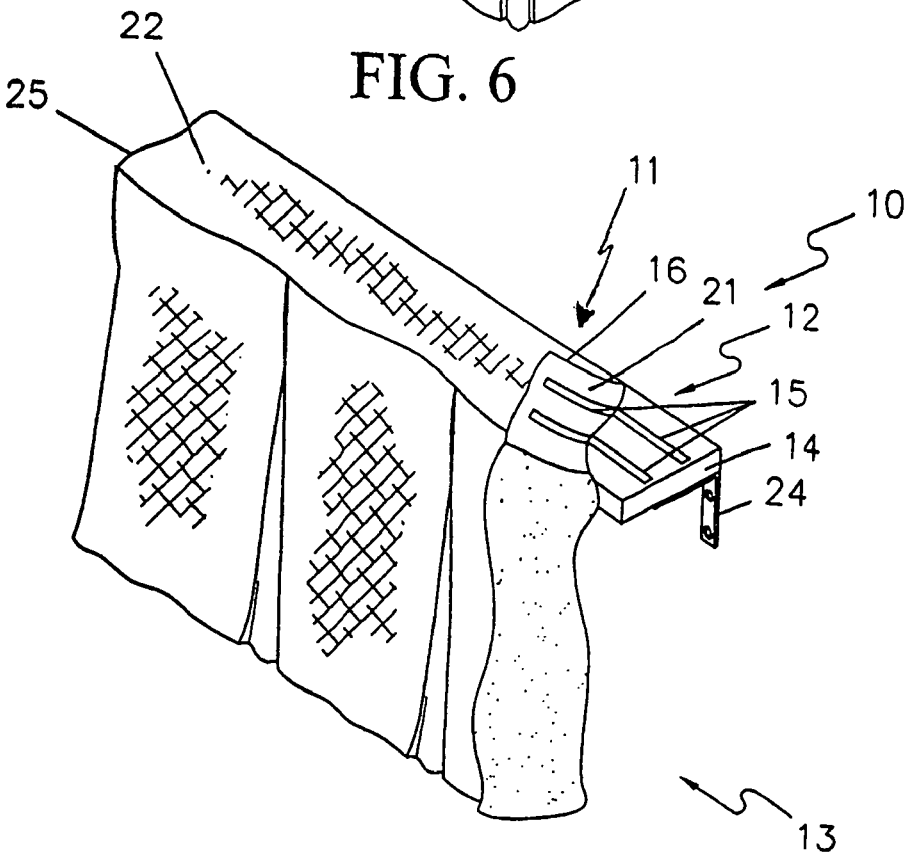
FIG. 7 is a perspective view of the reclosable rib and groove tape according to FIG. 6, shown on the valance and cornice board.

Referring to FIGS. 6 and 7, the rib and groove tape assembly 10 is applied to a valance as the fabric add-on 13, and a corresponding cornice board as the foundation 14. The cornice board foundation 14 is attached to a substantially vertical wall of a room in a house, etc. by cornice board attachment brackets 24, for example. The add-on attachment portion 11 is attached to an inside surface 21 of the upper panel 22 of the valance fabric add-on 13 by sewing or other suitable means. The foundation attachment portion 12 is attached to the cornice board foundation 14 by stapling or other suitable means. As seen in FIG. 7, the upper panel 22 of the fabric add-on 13 is attached to the foundation attachment portion 12 on the top surface 23 of the cornice board foundation 14 when the fabric add-on is in use. As seen in FIGS. 6 and 7, the remainder of the valance fabric add-on 13 hangs down substantially vertically from the narrower, substantially horizontal upper panel 22. Similarly, the bed skirt fabric add-on of FIGS. 3 and 4 hangs down substantially vertically from the narrower, substantially horizontal upper panel 22 when the bed skirt is in use on a bed. The division between the upper panel 22 and the reminder of the fabric add-on 13 is ordinarily simply a seam sewn in the fabric (see FIGS. 6 and 7). Since the upper panel 22 is substantially perpendicular to the remainder of the valance fabric add-on in the assembly 10 of FIGS. 6 and 7, the end edges 25 of the upper panel 22 are each sewn to a top edge of the ends of the remainder of the fabric add-on.

The rib and groove tape assembly 10 can be used to attach a valance fabric add-on 13 to a top edge of a mirror foundation 14, or the plastic, horizontal top piece of a set of vertical blinds. In this application, the rib and groove assembly 10 need only comprise one rib row on the valance fabric add-on 13 and a corresponding groove row on the corresponding mirror or blind top piece foundation 14, or vice versa, since most valances are narrow and do not weigh much.

Figure 12:
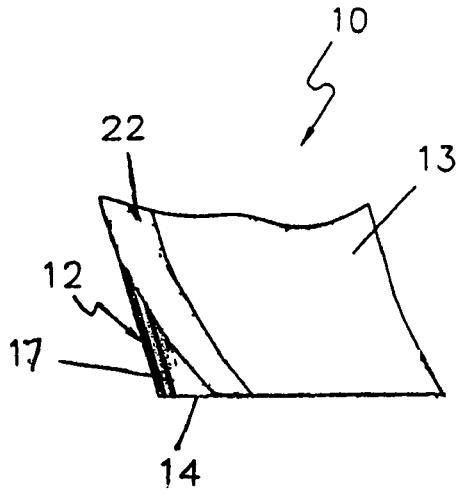
FIG. 12 is a perspective view of a reclosable rib and groove tape according to the present invention, shown on a pillow.

Turning to FIG. 12, the rib and groove tape assembly 10 comprises an add-on attachment portion 11 attached to a pillow sham fabric add-on 13 and a foundation attachment portion 12 attached to a pillow foundation 14. In this application, the rib and groove tape assembly 10 need only comprise one rib row on the panel 22 along the side of the pillow sham fabric add-on 13 and a corresponding groove row along the corresponding side of the pillow foundation 14, or vice versa, since most pillow shams do not weigh more than a pound or so, and the weight is usually more horizontal when the pillow is on a bed or couch than vertical (gravity). The pillow sham fabric add-on 13 can easily be removed so that the pillow can be used for sleeping, or for cleaning the pillow sham, or just to substitute another pillow sham in order to change décor in the room.

Figure 11:
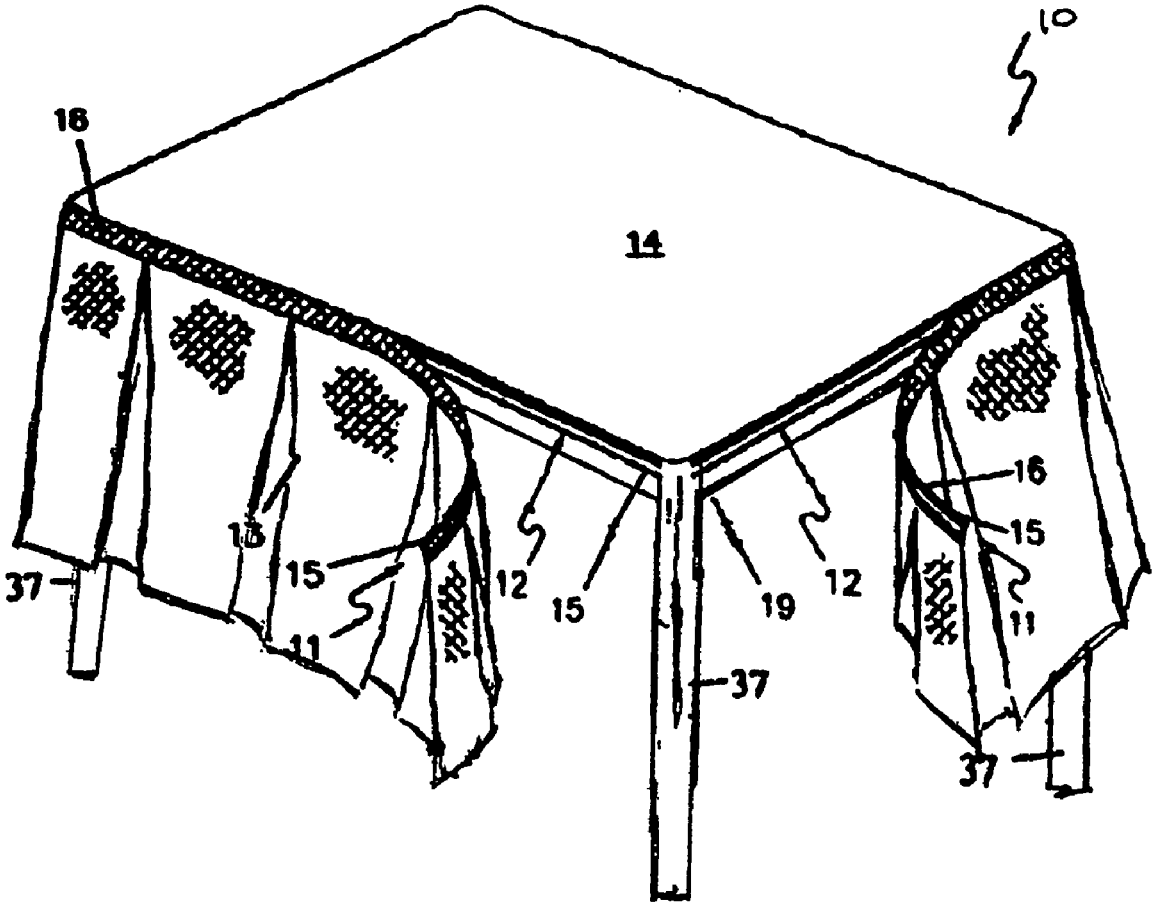
FIG. 11 is a perspective view of a reclosable rib and groove tape according to the present invention, shown on a table.

As shown in FIG. 11, the rib and groove tape assembly 10 comprises an add-on attachment portion 11 attached to a table skirt fabric add-on 13 and a foundation portion 12 attached to the sides 19 of a table foundation 14. The table top may be rectangular or circular in shape, with wide or narrow sides and short or long table legs 37 suitable for a coffee table, breakfast table, or dining room table, for example. The table skirt fabric add-on 13 may extend to the ground, necessitating multiple rib and groove tracks 15 (e.g., four), or it may be short, requiring only one or two tracks 15.

Figure 15:
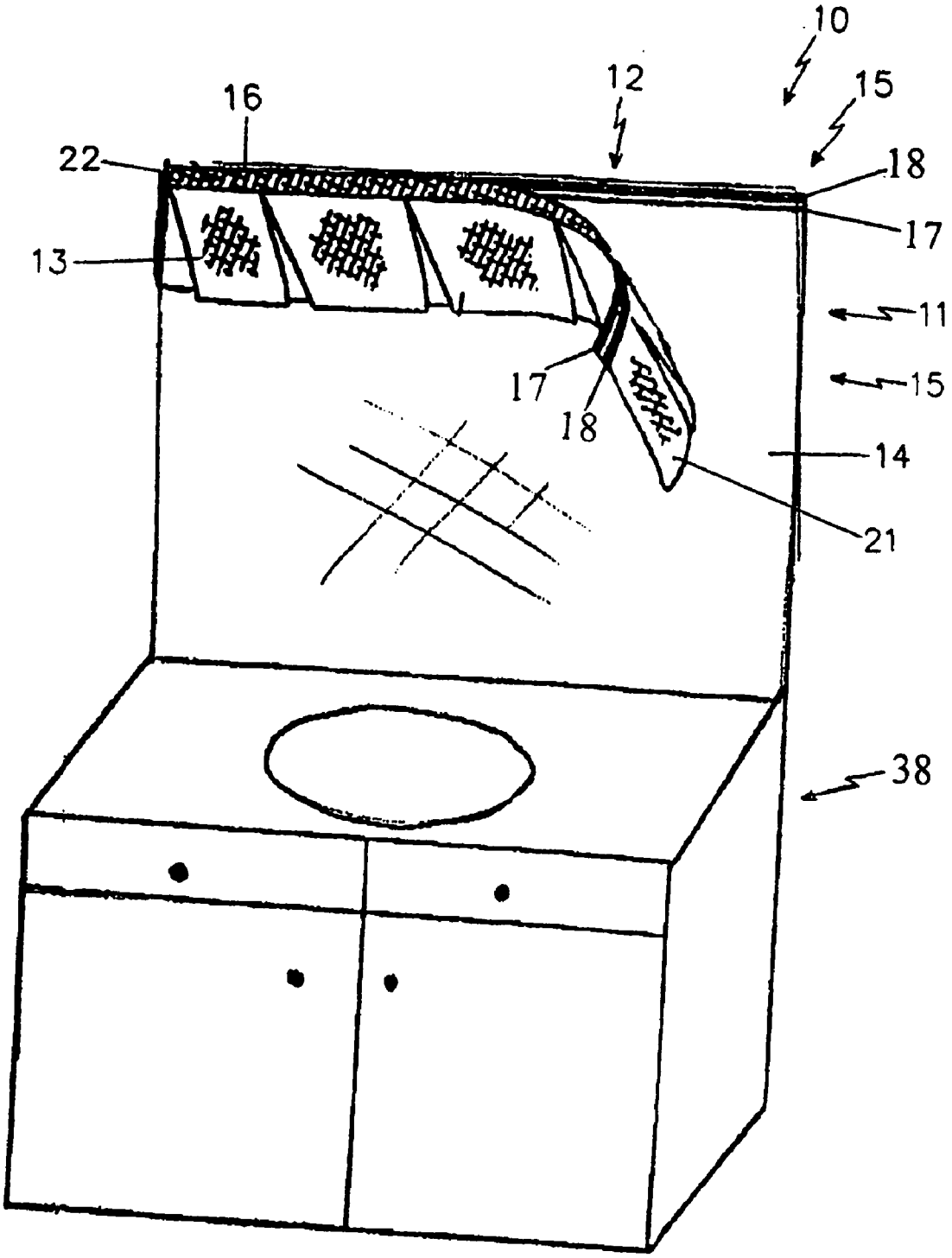
FIG. 15 is a perspective view of a reclosable rib and groove tape according to the present invention, shown over a vanity mirror.

Turning to FIG. 15, the rib and groove tape assembly 10 comprises a valance fabric add-on 13 on a mirror foundation 14. The valance in FIG. 15 is shown partially detached for purposes of illustration. The foundation attachment portion 12 is adhered to the top edge of the mirror foundation 14. The add-on attachment portion 11 is attached to the inside surface 21 of the upper panel 22 of the relatively lightweight valance fabric add-on 13. Here, the add-on attachment portion 11 and the foundation attachment portion 12 each include one rib 17 and one groove 18. As shown in FIG. 15, the rib 17 of the add-on attachment portion 11 corresponds to the groove 18 on the foundation attachment portion 12. The mirror foundation 14 is above, or part of, a bathroom or bedroom vanity 38.

The reclosable rib and groove tape assembly 10 is also useful for attaching crib skirt fabric add-ons to baby cribs (not shown), bassinet skirt fabric add-ons to the sides of baby bassinets, sink skirt fabric add-ons to the sides of kitchen or bathroom sinks, waterproof canvas boat seats or console covers to boat seats or consoles, sofa skirt fabric add-ons to the bottoms of sofas/couches, bed skirts to the bottoms of convertible/day beds, shower curtains to shower rods or the like, window curtains to window curtain rods, and other types of curtains to curtain hanging rods or the like, for example. The latter of these (e.g., cribs, sofas) are the foundations 14. Also, the foundation 14 may be any second fabric article. The fabric add-on 13 may be made of a fabric-like material, as in the case of a plastic-containing shower curtain or a netted bassinet skirt.

Figure 26:
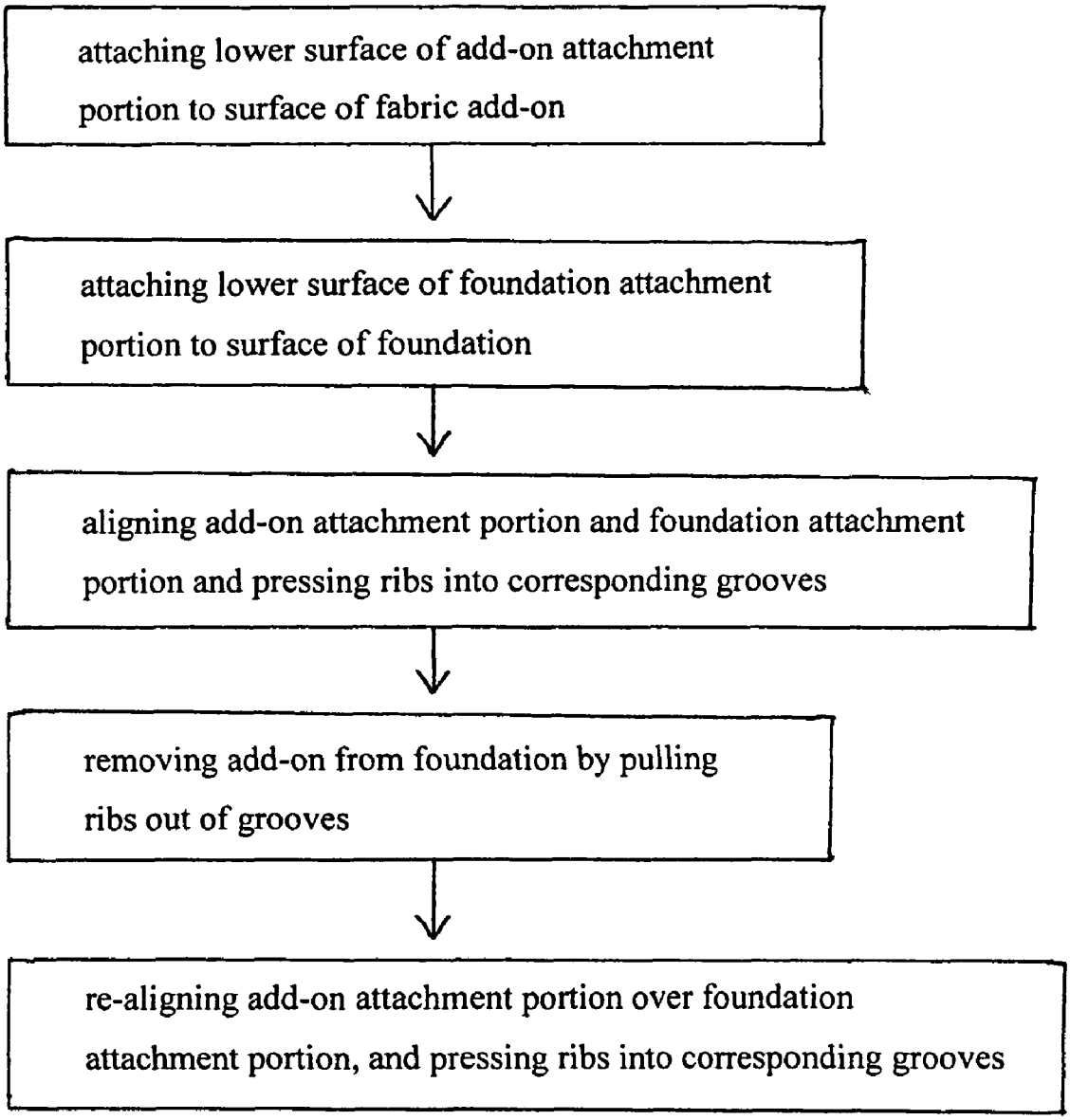
FIG. 26 is a diagram showing a method according to the present invention for releasably attaching a fabric add-on to a foundation using a reclosable rib and groove tape assembly.

Also included herein is a method for hanging a fabric add-on 13 on a foundation 14 using the reclosable locking tape 10, 40 described herein. Referring to FIG. 26, the method comprises the following steps: (a) attaching a lower surface 26 of an add-on attachment portion 11 of the reclosable rib and groove tape assembly 10 adjacent a longitudinal edge 16 of a fabric add-on 13; (b) attaching a lower surface 26 of an opposite, foundation attachment portion 12 of the reclosable rib and groove tape assembly 10 onto a surface (e.g., side 19 or top 20) of a foundation 14; (c) reclosably attaching the fabric add-on 13 to the foundation 14 by aligning the add-on attachment portion 11 along the foundation attachment portion 12 and pressing at least one rib 17 of the add-on attachment portion 11 into at least one, corresponding groove 18 of the foundation attachment portion 12, or vice versa (pressing at least one rib 17 of the foundation attachment portion 12 into at least one, corresponding groove 18 of the add-on attachment portion 11). The method of the present invention preferably further includes step: (d) removing the fabric add-on 13 from the foundation 14 by pulling the at least one rib 17 of one attachment portion 11, 12 out of the at least one groove 18 of the opposite attachment portion 11, 12. The method of the present invention preferably further comprises the step of: (e) re-attaching the fabric add-on 13 to the foundation 14 by aligning the add-on attachment portion 11 along the foundation attachment portion 12, and pressing a rib 17 of the add-on attachment portion 11 into one of the corresponding grooves 18 of the foundation attachment portion 12, or a groove 18 of the add-on attachment portion 11 into one of the corresponding ribs 17 of the foundation attachment portion 12.

Continuing with the method of the present invention, the attachment portions 11, 12 are preferably attached to the fabric add-on 13 or the foundation 14 by removing a strip of peel-off cover strip 28 from a suitable adhesive on the lower surface 26 of the attachment portion 11, 12, and pressing the lower surface of the attachment portion 11, 12 against the fabric add-on 13 or foundation 14. Alternatively, the add-on attachment portion 11 is sewn to the fabric add-on 13, and/or the foundation attachment portion 12 is stapled to the cornice board foundation 14, particularly where the cornice board is wooden.

The present invention does not require hook and loop material. No zipper or slider is employed herein. Instead, the current invention employs a reclosable tape having a rib row, or male portion, and a complementary groove row, or female portion. The rib rows/male portions and groove rows/female portions are preferably made of a plastic-type material.

The reclosable locking tape assembly 10, 40 herein preferably does not include hook and loop fastener or a zipper slider. The interlocked tape assembly 10, 40 is not as thick as attached hook and loop strips often are, nor does the reclosable tape assembly 10, 40 pucker while it is in use. The add-on 13 and foundation 14 substrates herein are preferably made of fabric or the like. The reclosable interlocked tape assembly of the present invention is not intended for use, though, with or on thermoplastic bags or similar containers.

Turning to FIGS. 16-25, another reclosable tape assembly herein is a reclosable locking tape 40 that includes a female locking portion 41 and a corresponding male locking portion 42. (A rib herein is a male locking portion and a groove herein is a female locking portion.) As with the rib and groove tape 10, there may be two or more portions, or tracks, on a length of reclosable locking tape 40, such as two male locking portions 41 alternating with two female locking portions 42 (e.g., male-female-male-female, side by side). The reclosable locking tape 40 may include side by side male locking portions 42 on a first tape strip, and side by side female locking portions 41 on the other, corresponding tape strip, as seen in cross-section in FIG. 16 and on a bed in FIG. 20. In the variation depicted in FIG. 20, two male locking portions 42 on the first tape strip, which is on the bed skirt add-on 13, couple with two female locking portions 41 on the second tape strip, which is attached to the box spring foundation 14, when the first and second tape strips are zipped together.

Figure 17:
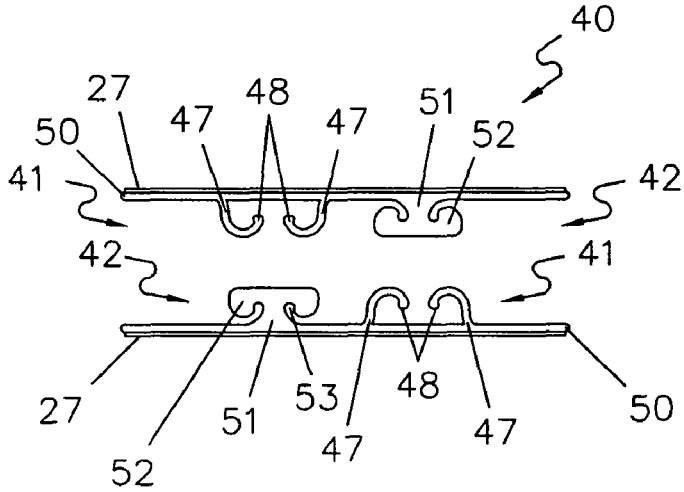
FIG. 17 is a perspective view of a reclosable rib and groove tape according to the present invention.
Figure 18:
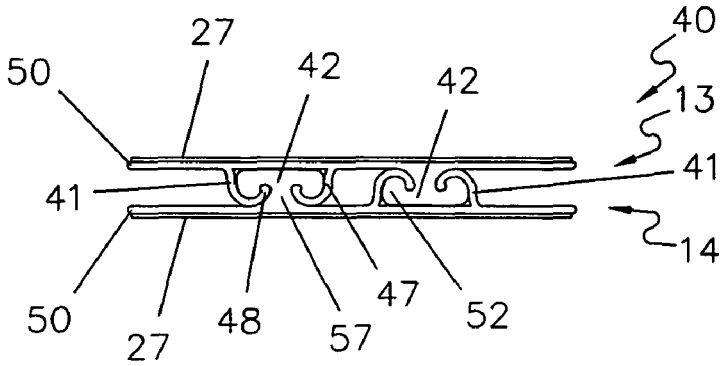
FIG. 18 is a perspective view of a reclosable rib and groove tape according to the present invention.
Figure 25:
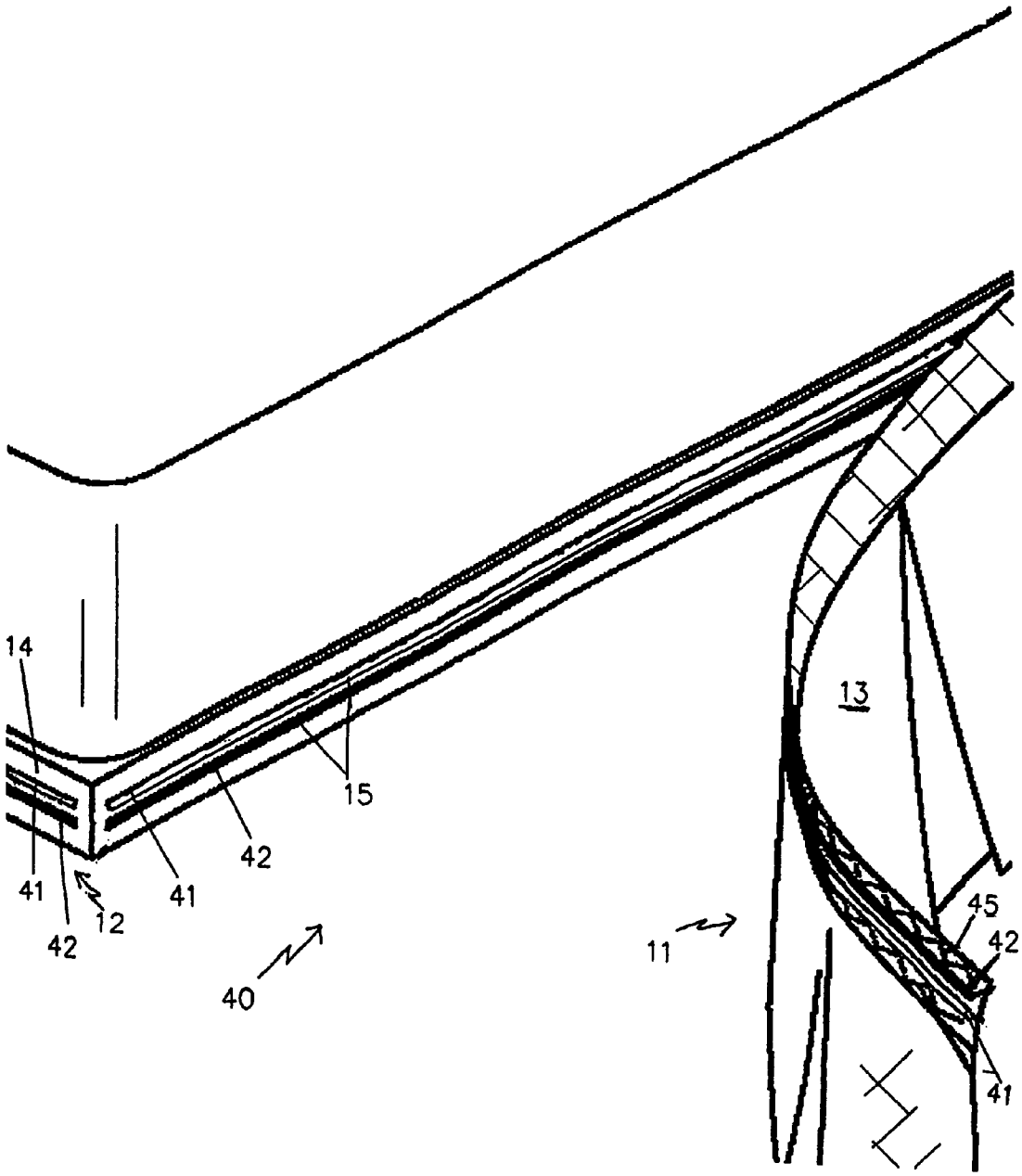
FIG. 25 is an expanded perspective view of a reclosable locking tape according to the present invention.

As seen in FIGS. 17, 18, and 25, the reclosable locking tape 40 preferably includes a male locking portion 42 and a female locking portion 41 side by side and spaced apart. The same type of reclosable locking tape 40, which is shown in an unlocked, open position in FIG. 17 and a closed, locked position in FIG. 18, can be used on both the foundation 14 and the fabric add-on 13. Since the reclosable locking tape 40 can be used on both sides of the substrate (foundation and add-on), only one type of reclosable tape, and one package to hold the reclosable tape, need be produced. This reduces costs for both the manufacturer and the consumer. The consumer-user need only purchase and use one roll of the reclosable locking tape 40, or several identical rolls depending on the length of the periphery to be covered.

Figure 19:
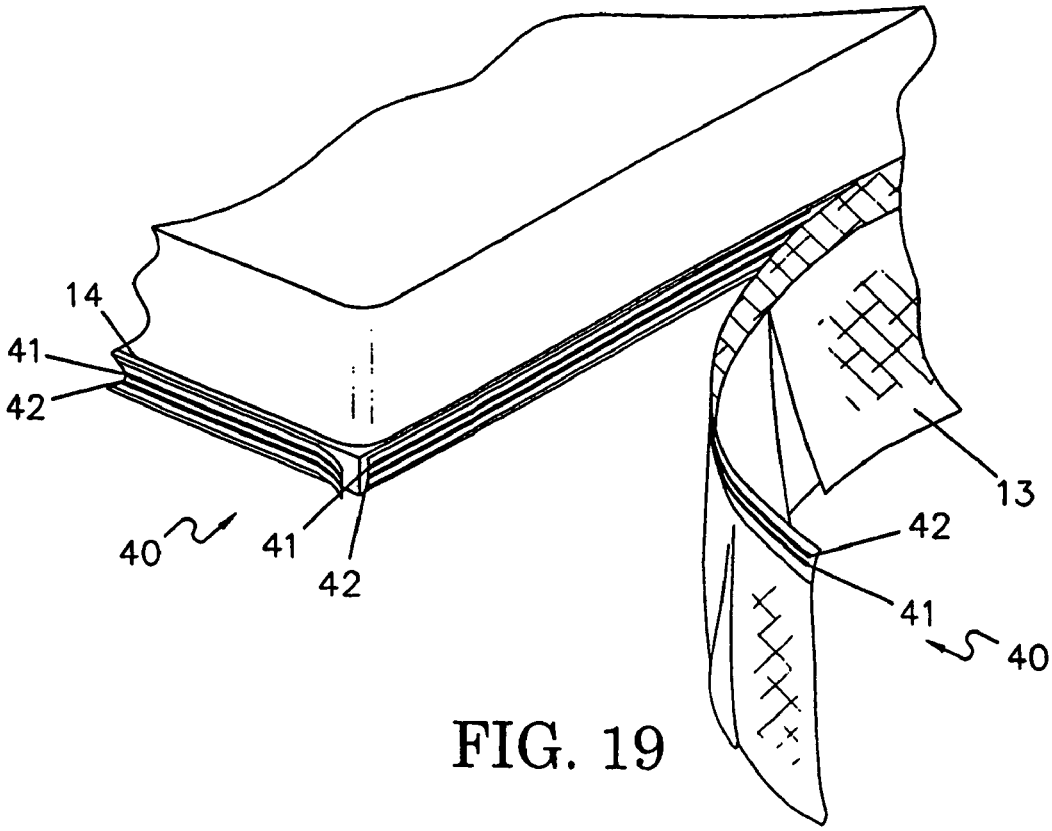
FIG. 19 is a perspective view of a reclosable locking tape according to the present invention, shown on a bed skirt and a base of a bed.

The consumer preferably prepares the foundation 14 and fabric add-on 13 for use. First, the consumer pulls the desired strip length (24 inches, for example) out of a box or other suitable package containing the roll of reclosable locking tape 40 and cuts it. The consumer peels off the peel-off cover strip 28 that is removably adhered to the back of the reclosable locking tape 40 and sticks the rear surface of the reclosable locking tape 40 to the bottom surface of the add-on 13 along its edge. The rear surface of the tape base 50 is opposite its front surface, on which the tracks 15 are located. The peel-off cover strip 28 is preferably marked with inch or other appropriate increments or instructions that the average consumer may find helpful. The consumer continues peeling off strips of the reclosable locking tape 40, lining each locking tape strip up with the end of the preceding locking tape strip on the fabric add-on 13, or at the corner of the add-on 13 as seen in FIG. 19. No slider closure or special structure is required to zip or unzip the reclosable tape strips or to hold them in place.

The consumer then performs the same process on the foundation 14, applying strips of the locking tape 40 along the edges of the foundation 14 that corresponds to the fabric add-on 13 as seen in FIG. 19. However, the locking tape strips being applied to the foundation 14 are rotated so that the male locking portion 42 of the foundation attachment portion 12 of locking tape 40 corresponds to the female locking portion 41 on the add-on attachment portion 11 of reclosable locking tape 40 that has been attached to the fabric add-on 13. Since the male and female locking portions 41, 42 are side by side and lined up with one another on the locking tape 40, this procedure also lines the female locking portions 41 of the foundation attachment portion 12 up with the male locking portions 42 of the add-on attachment portion 11. With this rotatable locking tape 40, the consumer need not be confused by having to purchase and apply two different types of locking tape, one with ribs and one with grooves. The male locking portion 42 in a male portion track locks into a track with the corresponding female locking portion 41 for the length of the side of the add-on 13 and foundation 14 (see FIG. 25). As seen in FIGS. 19-21, and 25, the tracks 15 in a strip of the locking tape 40 are preferably substantially straight and parallel to one another and to the opposite longitudinal edges of the locking tape 40. The locking tape 40 may be attached using zigzag stitching 45 as seen in FIG. 25, sewing, stapling, or adhesive and a peel-off cover strip as described herein, or by any other suitable means. The bed skirt add-on 13 is either long enough to extend around three or four sides of the box spring foundation 14, or the user employs a separate length of bed skirt add-on 13 for each side of the box spring foundation 14. In the latter case, a tape strip is attached along the upper edge of each length of bed skirt. One side of the bed may be pushed against a wall, in which case the bed skirt need not cover the hidden side of the bed.

Figure 20:
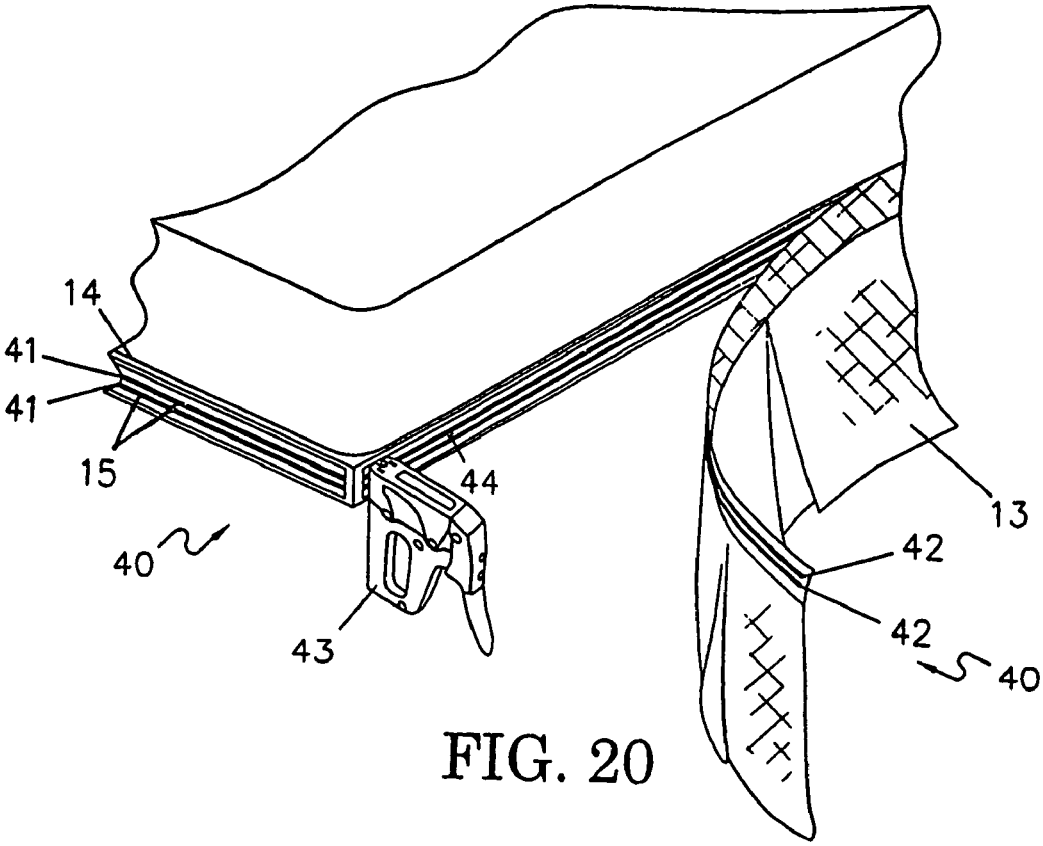
FIG. 20 is a perspective view of a reclosable locking tape according to the present invention, shown on a bed skirt and a base of a bed.

Alternative means of applying the reclosable tape 10, 40 may be used herein instead of adhesive and the back peel-off cover strip. The reclosable tape 10, 40 may be applied using staples 44, for example. Referring to FIG. 20, the staples may be applied intermittently along the locking tape 40 using a staple gun 43, if desired. The reclosable tape 10, 40 may alternatively be applied using zigzag stitching 45 as seen on the add-on attachment portion 11 in FIGS. 21 and 25. In the latter case (FIGS. 21 & 25), a zigzag stitch 45 is used to sew the reclosable locking tape strips to the add-on 13 using a sewing machine.

Figure 22:
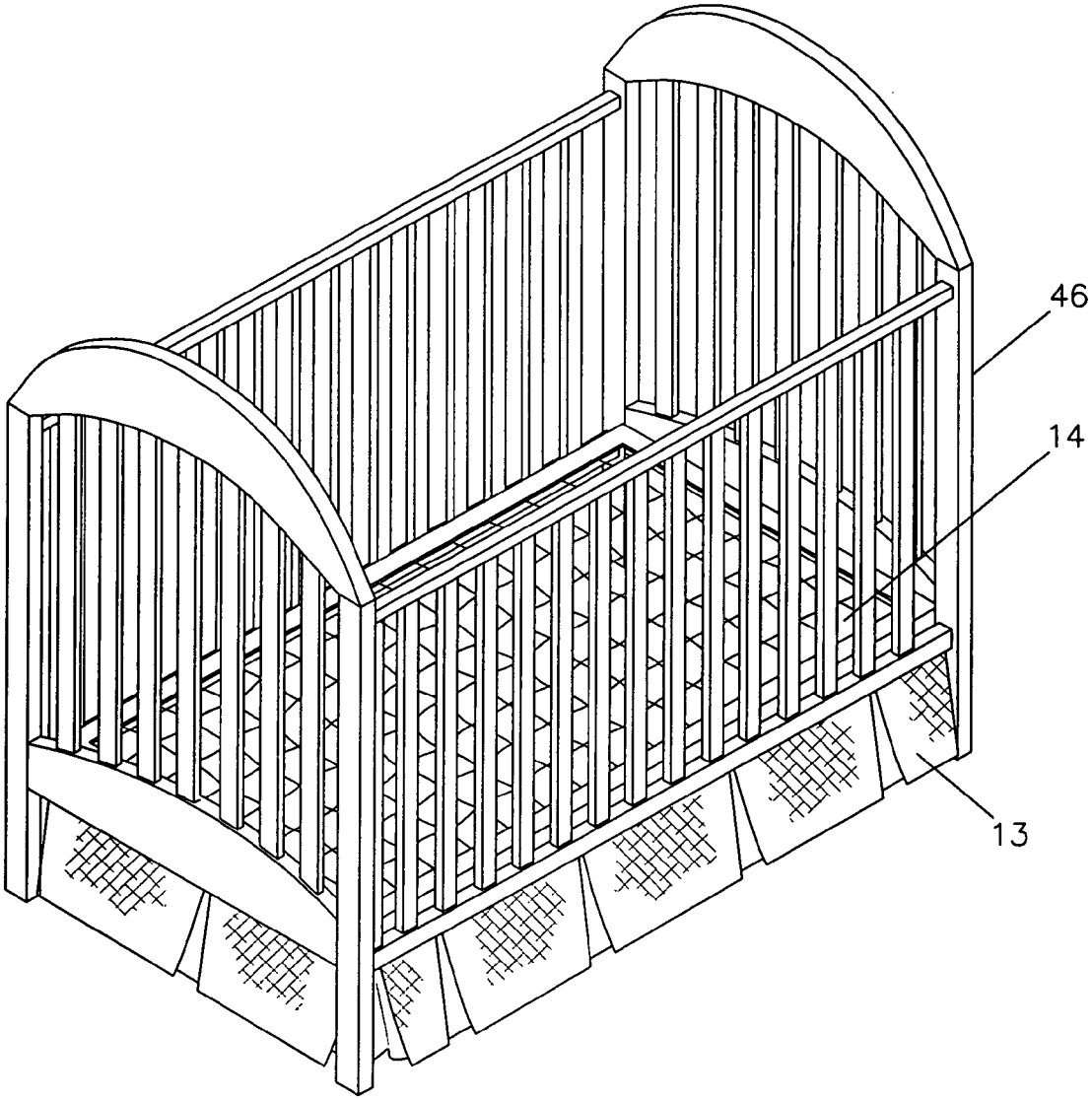
FIG. 22 is a perspective view of a reclosable locking tape assembly according to the present invention, shown on a crib.
Figure 23:
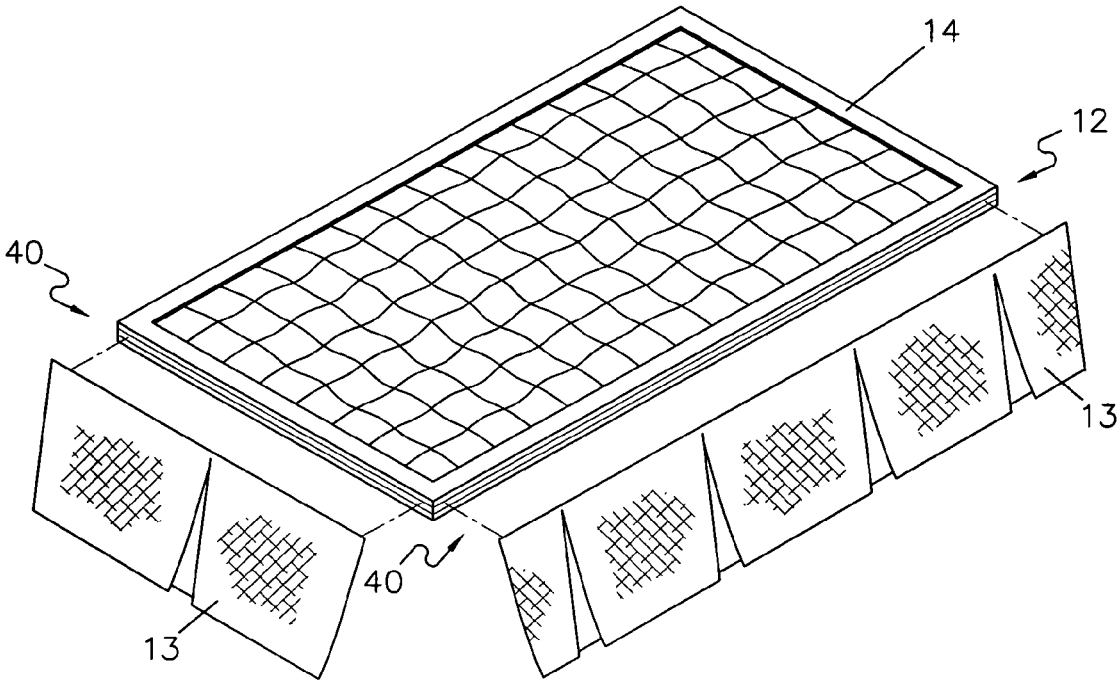
FIG. 23 is a perspective view of the reclosable locking tape according to FIG. 22.
Figure 24:
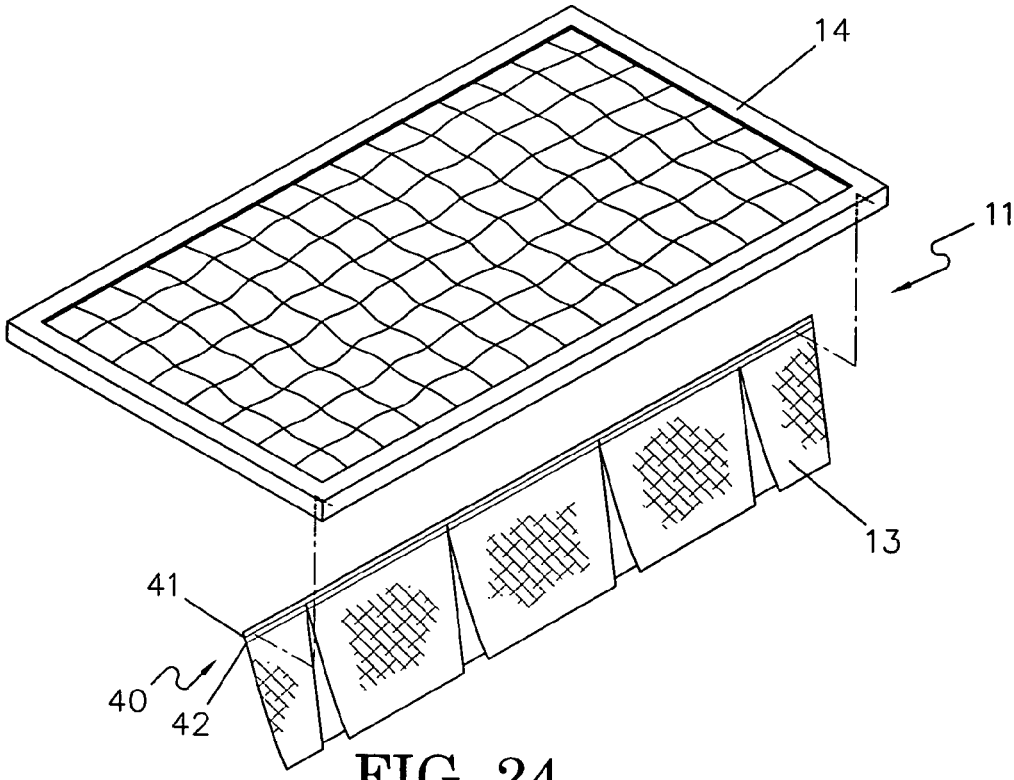
FIG. 24 is a perspective view of a reclosable locking tape according to the present invention, shown on a bed skirt and a base of a crib.

Turning to FIGS. 22-24, the locking tape 40 may be applied to a crib bed skirt add-on 13 and a crib foundation 14. The foundation attachment portion 12 of the locking tape 40 may be attached to an outside of the sides of the crib foundation 14 as seen in FIG. 23, or to the inside of a front side of the crib foundation 14 as seen in FIG. 24. In the former case shown in FIG. 23, the add-on attachment portion 11 of the locking tape 40 is attached to a rear top edge of the bed skirt add-on 13, and to a front top edge of the bed skirt add-on 13 in the latter case as seen in FIG. 24. In the latter case (FIG. 24), the rear of the crib 46 would likely be placed against a wall of the bedroom.

Figure 16:
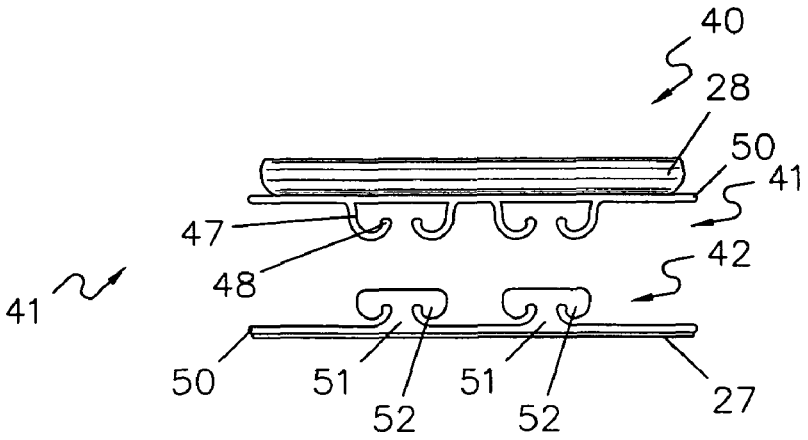
FIG. 16 is a perspective view of a reclosable rib and groove tape according to the present invention.

Referring again to FIGS. 16-18, the reclosable locking tape 40 comprises at least one female locking portion 41 and at least one male locking portion 42, each of which is affixed to a substantially planar tape base 50. The words "affixed to" here are meant to include "attached to" or "extending from". The reclosable locking tape 40 is preferably molded of plastic, with adhesive 27 applied on the rear of the tape base 50, and a peel-off cover strip 28 over the adhesive 27, as seen in FIG. 16. The peel-off cover strip 28 is made of a paper material and substantially covers the adhesive 27 and the back of the tape base.

Continuing with FIGS. 16-18, the female locking portion 41 of the reclosable locking tape 40 comprises two same-sized matching hook members 47 with hooked ends 48 that face toward one another on opposite sides of a male portion sized space 49 at the center of the female locking portion 41. The male locking portion 42 of the reclosable locking tape 40 is generally T-shaped, or more specifically generally mushroom-shaped in transverse cross-section (most preferably like a shiitake or button mushroom cut in half lengthwise). The male locking portion 42 comprises a generally mushroom stem-shaped stem 51 that is affixed to a generally mushroom cap-shaped cap 52 at the end of the stem 51, as seen in FIGS. 16 and 17. The top of the mushroom cap-shaped cap 52 of the male locking portion 42, and therefore the bottom of the generally mushroom cap-shaped space 49 in the female locking portion 41, are substantially planar. When locking tape strips are zipped together (without any slider) as depicted in FIG. 18, the female portion hook members 47 engage correspondingly shaped, hooked end-receiving sections 53 of the male locking portion 42 to releasably lock the male locking portions 42 into the female locking portions 41. The weight of the fabric add-on 13 is thus supported when the add-on attachment portion 11 is attached to the foundation attachment portion 12. The foundation attachment portion 12 is whichever tape portion is attached to the foundation 14, and the add-on attachment portion 11 is whichever tape portion is attached to the add-on 13. The attachment portions 11, 12 are preferably made of polypropylene or polyethylene material. Preferably, the user feels a bump in his or her fingers as the male locking portion 42 snaps into the opposite, female locking portion 41. A snap sound is preferably audible to the user as the male locking portion 42 pops into the corresponding female locking portion 41.

Also included herein is a combination reclosable locking tape assembly that includes a first strip, or section, of the reclosable locking tape 40 attached to a fabric add-on 13, and a second strip of the same reclosable locking tape 40 attached to a corresponding foundation 14. The second tape strip, which is the foundation attachment portion 12, has been rotated about 180 degrees from the placement of the first tape strip prior to its attachment to the foundation (or vice versa) so that the male portion on the add-on 13 corresponds to the female portion on the foundation 14, and the female portion on the add-on corresponds to the male portion on the foundation. The first tape strip is the add-on attachment portion 11. The first and second tape strips are each about the same length and are located on the add-on 13 and foundation 14 so that the bed skirt or other fabric add-on will be in an appropriate position on the box spring or other foundation.

Figure 21:
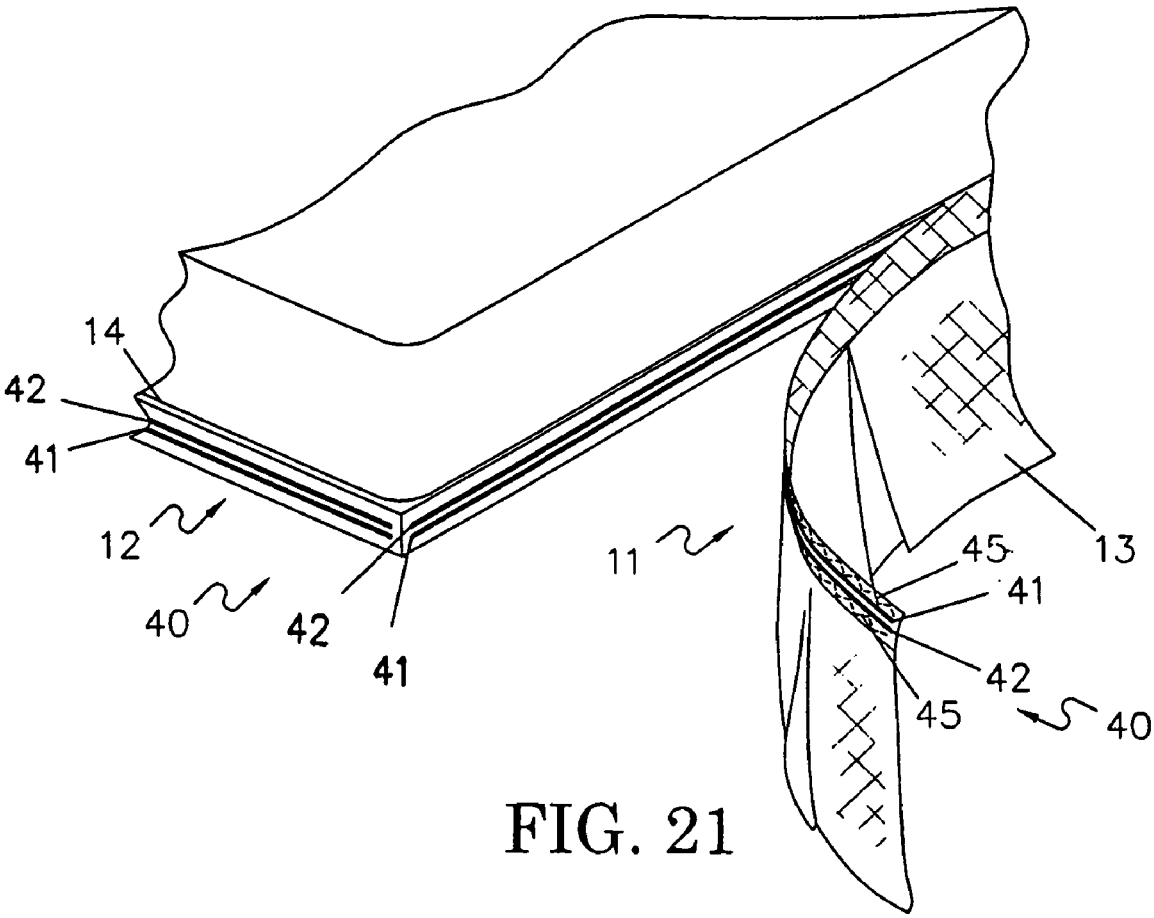
FIG. 21 is a perspective view of a reclosable locking tape according to the present invention, shown on a bed skirt and a base of a bed.

The first and second strips of reclosable tape 10, 40 may extend continuously along the length, width and/or thickness of the add-on and foundation part, or the strips may be segments of the reclosable tape 10, 40 with short spaces in between the tape segments. Tape segments like the segments seen in FIG. 13 might be used instead of the continuous tape strips to hold down costs, for example. Tape segments can be used where the add-on has uneven places in the fabric, such as pleats on an add-on curtain or drape, for example. The tracks 15 on each tape strip preferably extend continuously along the length of the reclosable tape 10, 40 and are preferably substantially parallel to one another and to the opposite longitudinal edges of the tape base 50 along the length of the tape strip. The tracks on one tape strip are preferably one female locking portion 41 and one male locking portion 42. When the add-on 13 hangs generally vertically as seen in FIGS. 19-21, the male locking portion 42 can be the upper track on the add-on 13 as shown in FIGS. 19 and 20, with the female locking portion 41 then being the upper track on the side of the foundation 12. Alternatively, the male locking portion 42 can be the lower track as seen in FIG. 21, with the female locking portion 41 being the lower track (i.e., below the male portion upper track) on the side of the foundation 14.

Suitable add-on/foundation combinations include the following: the fabric add-on 13 is a valance, and the foundation 14 is a cornice board; the fabric add-on 13 is a tablecloth and the foundation 14 is a table top; the fabric add-on is a pillow sham and the foundation is a pillow; the fabric add-on is a sofa skirt and the foundation is a sofa; the fabric add-on is a skirt and the foundation is a sink or crib; the fabric add-on is a bassinet skirt and the foundation is a baby's bassinet; the fabric add-on is a curtain and the foundation is a curtain hanging rod; and the fabric add-on is a waterproof canvas boat seat or console cover and the foundation is a boat seat or console. Once the complementary tracks 15 of the add-on 13 and corresponding foundation 14 are pressed together, the add-on ordinarily stays in place on the foundation until it is pulled off by a person. No special closure or mechanism is needed at the ends of the tape strips, which are ordinarily at the ends of the add-on or foundation. For removal, the user simply grasps a corner of the tape base 50 on the add-on 13 and pulls the add on attachment portion, or tape strip, away from the foundation attachment portion, or tape strip. The tracks 15 come apart easily and quickly.

From the foregoing it can be realized that the described tape assembly and method of the present invention may be easily and conveniently utilized as a reclosable locking tape for releasably attaching an article made of fabric or other material to a foundation. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 rib and groove tape assembly
11 add-on attachment portion
12 foundation attachment portion
13 add-on
14 foundation
15 tracks
16 upper edge of fabric add-on
17 ribs
18 grooves
19 side of foundation
20 top surface of foundation
21 inside surface of fabric add-on
22 upper panel of fabric add-on
23 top of cornice board
24 attachment bracket
25 end edges of upper panel
26 lower surface of backing
27 adhesive
28 peel-off cover strip
29 bed frame
31 groove sides
32 groove well
33 knob-shaped member
34 rib stem
35 upper surface of backing
36 portion backing
37 table legs
38 vanity
40 reclosable locking tape
41 female locking portion
42 male locking portion
43 staple gun
44 staples
45 zigzag stitching
46 crib
47 hook of female portion
48 hooked ends
49 space in female portion
50 tape base
51 stem of male portion
52 cap of male portion
53 hook end-receiving section

What is claimed is:

1. A reclosable rib and groove tape assembly for reclosably attaching a fabric add-on to a foundation, the tape assembly comprising: (a) an add-on attachment portion comprising at least one longitudinally extending rib or at least one longitudinally extending groove on a substantially planar, substantially flexible portion backing; and (b) a separate foundation attachment portion comprising the at least one rib or the at least one groove on a substantially planar, substantially flexible portion backing; wherein the tape assembly comprises one of the at least one ribs on one of the attachment portions for every one of the at least one grooves on a corresponding one of the attachment portions; and the at least one rib in transverse cross-section comprises a knob-shaped member on a stem, the rib stem extending substantially perpendicularly from the corresponding portion backing; the at least one groove comprising a groove well, the rib knob-shaped member extending into the groove well when the at least one rib is in the corresponding at least one groove of the corresponding attachment portion; wherein the add-on attachment portion is attached to the fabric add-on and the foundation attachment portion is attached to the foundation; and wherein the tape assembly does not comprise a slider.

2. The rib and groove tape assembly according to claim 1, wherein the at least one groove further comprises opposite, flexible groove sides, the opposite groove sides contacting at least a portion of the rib stem when the at least one rib is in the corresponding at least one groove.

3. The rib and groove tape assembly according to claim 1, wherein the fabric add-on is a bed skirt and the foundation is a box spring.

4. The rib and groove tape assembly according to claim 1, wherein the at least one rib and the at least one groove are made of a low density polyethylene material; and wherein the foundation is not a thermoplastic bag.

5. The rib and groove tape assembly according to claim 1, wherein the add-on is a valance, and the foundation is a cornice board.

6. The rib and groove tape assembly according to claim 3, wherein the add-on is a tablecloth and the foundation is a table top.

7. The rib and groove tape assembly according to claim 4, wherein the fabric add-on is a pillow sham and the foundation is a pillow.

8. The rib and groove tape assembly according to claim 1, wherein the fabric add-on is a sofa skirt and the foundation is a sofa.

9. The rib and groove tape assembly according to claim 1, wherein the add-on is a skirt and the foundation is a sink or crib.

10. A reclosable locking tape for releasably attaching an add-on to a foundation, the locking tape comprising: (a) a substantially planar tape base to which is affixed at least one male locking portion, the male locking portion being generally mushroom-shaped in transverse cross section and comprising a stem affixed to a cap at one end of the stem, an opposite end of the stem being affixed to the tape base; and (b) at least one female locking portion affixed to the tape base, the female locking portion corresponding to the at least one male locking portion and comprising two substantially same-sized hook members that face toward one another on opposite sides of a male locking portion-sized space in the female locking portion; wherein the at least one male locking portion of a first strip of the reclosable locking tape releasably couples with the corresponding at least one female locking portion of a second, corresponding strip of the reclosable locking tape; and wherein the locking tape does not comprise a slider.

11. A reclosable locking tape for releasably attaching an add-on to a foundation, the locking tape comprising: (a) a substantially planar tape base to which is affixed at least one male locking portion, the male locking portion being generally mushroom-shaped in transverse cross section and comprising a stem affixed to a cap at one end of the stem, an opposite end of the stem being affixed to the tape base; and (b) at least one female locking portion affixed to the tape base, the female locking portion corresponding to the at least one male locking portion and comprising two substantially same-sized hook members that face toward one another on opposite sides of a male locking portion-sized space in the female locking portion; and further comprising an adhesive on a rear surface of the tape base, and a peel-off cover strip of a paper material substantially covering the adhesive; wherein the tape assembly does not comprise a slider; and wherein the at least one male locking portion of a first strip of the reclosable locking tape releasably couples with the corresponding at least one female locking portion of a second, corresponding strip of the reclosable locking tape.

12. The reclosable locking tape according to claim 11, wherein the female locking portion hook members engage correspondingly shaped sections of the male locking portion to couple the first and second locking tape strips together.

13. A method for releasably attaching a fabric add-on to a foundation using a reclosable rib and groove tape assembly, the method comprising the steps of: (a) attaching a lower surface of an add-on attachment portion of the reclosable rib and groove tape assembly to the fabric add-on; (b) attaching a lower surface of a foundation attachment portion of the reclosable rib and groove tape assembly onto a surface of a foundation; and (c) aligning the add-on attachment portion over the foundation attachment portion and pressing at least one rib of the add-on attachment portion into at least one, corresponding groove of the foundation attachment portion, or at least one groove of the add-on attachment portion onto at least one, corresponding rib of the foundation attachment portion; wherein the tape assembly does not comprise a slider.

14. The method according to claim 13, wherein step (a) or (b) further comprises the sub-steps of: attaching the attachment portions to the fabric add-on or the foundation by removing a strip of peel-off cover strip from an adhesive on the lower surface of the attachment portion, and pressing the lower surface of the attachment portion against the fabric add-on or foundation.

15. The method according to claim 13, wherein the add-on attachment portion is sewn to the fabric add-on, and the foundation attachment portion is sewn or stapled to the foundation.

16. The method according to claim 13, further comprising the step of: (d) removing the fabric add-on from the foundation by pulling the at least one rib of one attachment portion out of the at least one groove of the corresponding attachment portion.

17. The method according to claim 16, further comprising the step of (e) re-attaching the fabric add-on to the foundation by re-aligning the add-on attachment portion to the foundation attachment portion, and pressing the at least one rib of the add-on attachment portion into the at least one, corresponding groove of the foundation attachment portion, or the at least one groove of the add-on attachment portion onto the at least one, corresponding rib of the foundation attachment portion.

* * * * *